US011624369B2

(12) United States Patent
Jung et al.

(10) Patent No.: US 11,624,369 B2
(45) Date of Patent: Apr. 11, 2023

(54) BLOWER

(71) Applicant: LG ELECTRONICS INC., Seoul (KR)

(72) Inventors: Jaehyuk Jung, Seoul (KR); Kidong Kim, Seoul (KR); Hoojin Kim, Seoul (KR); Haein Jung, Seoul (KR); Seokho Choi, Seoul (KR); Hyungho Park, Seoul (KR); Yongmin Kim, Seoul (KR); Chiyoung Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 31 days.

(21) Appl. No.: 17/318,274

(22) Filed: May 12, 2021

(65) Prior Publication Data

US 2021/0372436 A1 Dec. 2, 2021

(30) Foreign Application Priority Data

May 14, 2020 (KR) ..... 10-2020-0057728
Jun. 2, 2020 (KR) ..... 10-2020-0066278
(Continued)

(51) Int. Cl.
*F04D 25/08* (2006.01)
*F04D 25/06* (2006.01)
(Continued)

(52) U.S. Cl.
CPC ..... *F04D 25/08* (2013.01); *F04D 25/0606* (2013.01); *F04D 29/441* (2013.01); *F04D 29/703* (2013.01); *F04F 5/16* (2013.01)

(58) Field of Classification Search
CPC .... F04D 25/08; F04D 25/0606; F04D 29/441; F04D 29/703; F04D 25/10; F04D 25/14;
(Continued)

(56) References Cited

U.S. PATENT DOCUMENTS 10,184,495 B2 * 1/2019 Iyer ..... F04D 29/5826
10,969,122 B2 4/2021 Kim
(Continued)

FOREIGN PATENT DOCUMENTS

CN 101793431 8/2010
CN 205332468 6/2016
(Continued)

OTHER PUBLICATIONS

U.S. Office Action dated Apr. 11, 2022 issued in U.S. Appl. No. 17/318,242.
(Continued)

*Primary Examiner* — Aaron R Eastman
(74) *Attorney, Agent, or Firm* — Ked & Associates, LLP

(57) ABSTRACT

A blower includes a first extension having a first discharge port formed in a first wall, a second extension having a second discharge port formed in a second wall facing and spaced apart from the first wall, a fan provided below the first and second extensions to guide air toward each of the first tower and the second tower, a first gate provided inside the first tower or protruding from the first wall, a second gate provided inside the second tower or protruding from the second wall, a first guide motor to change a position of the first gate, and a second guide motor to change a position of the second gate.

20 Claims, 26 Drawing Sheets

(30) Foreign Application Priority Data

Jun. 2, 2020 (KR) ..... 10-2020-0066279
Jun. 2, 2020 (KR) ..... 10-2020-0066280

(51) Int. Cl.
*F04D 29/44* (2006.01)
*F04F 5/16* (2006.01)
*F04D 29/70* (2006.01)

(58) Field of Classification Search
CPC ..... F04D 29/524; F04D 29/563; F04F 5/16; F04F 5/44; F04F 5/466; F24F 8/10; F24F 1/0014
See application file for complete search history.

(56) References Cited

U.S. PATENT DOCUMENTS

| | | | |
|---|---|---|---|
| 2007/0129001 | A1 | 6/2007 | Orr |
| 2010/0226801 | A1 | 9/2010 | Gammack |
| 2012/0051884 | A1 | 3/2012 | Junkel et al. |
| 2014/0147297 | A1 | 5/2014 | Iyer et al. |
| 2017/0254548 | A1 | 9/2017 | Song |

FOREIGN PATENT DOCUMENTS

| | | |
|---|---|---|
| CN | 106123264 | 11/2016 |
| CN | 206877265 | 1/2018 |
| GB | 2568979 | 6/2019 |
| JP | 2013-015114 | 1/2013 |
| JP | 2015-152005 | 8/2015 |
| KR | 10-2011-0099318 | 9/2011 |
| KR | 10-2011-0100274 | 9/2011 |
| KR | 10-2018-0125425 | 11/2018 |
| KR | 10-2019-0015325 | 2/2019 |
| KR | 10-2019-0025443 | 3/2019 |
| WO | WO 2013/035271 | 3/2013 |
| WO | WO 2017/11058 | 6/2017 |
| WO | WO 2017/198763 | 11/2017 |

OTHER PUBLICATIONS

European Search Report dated Nov. 11, 2021 issued in Application No. 21173601.2.
Korean Office Action dated Oct. 25, 2021 issued in Application No. 10-2020-0057728.
Taiwan Office Action issued in Application No. 110117161 dated Jan. 3, 2022.

* cited by examiner

BLOWER

CROSS-REFERENCE TO RELATED APPLICATION(S)

This application claims priority under 35 U.S.C. § 119 to Korean Application Nos. 10-2020-0057728 filed on May 14, 2020; 10-2020-0066278 filed on Jun. 2, 2020; 10-2020-0066279 filed on Jun. 2, 2020; and 10-2020-0066280 filed on Jun. 2, 2020, whose entire disclosures are hereby incorporated by reference.

BACKGROUND

1. Field

The present disclosure relates to a blower.

2. Background

A blower may generate a flow of air to circulate air in an indoor space or to guide airflow toward a user. Recent blowers have been aimed at providing users with a better sense of comfort.

Korean Patent Publication Nos. KR2011-0099318, KR2011-0100274, KR2019-0015325, and KR2019-0025443 disclose a blowing device using a Coanda effect. Blowers may require a plurality of independently drive motors to move or rotate the blower so as to adjust a blowing direction. Effectively and gradually adjusting a blowing direction may be difficult, especially without consuming excessive power.

The above references are incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

Figure 1:
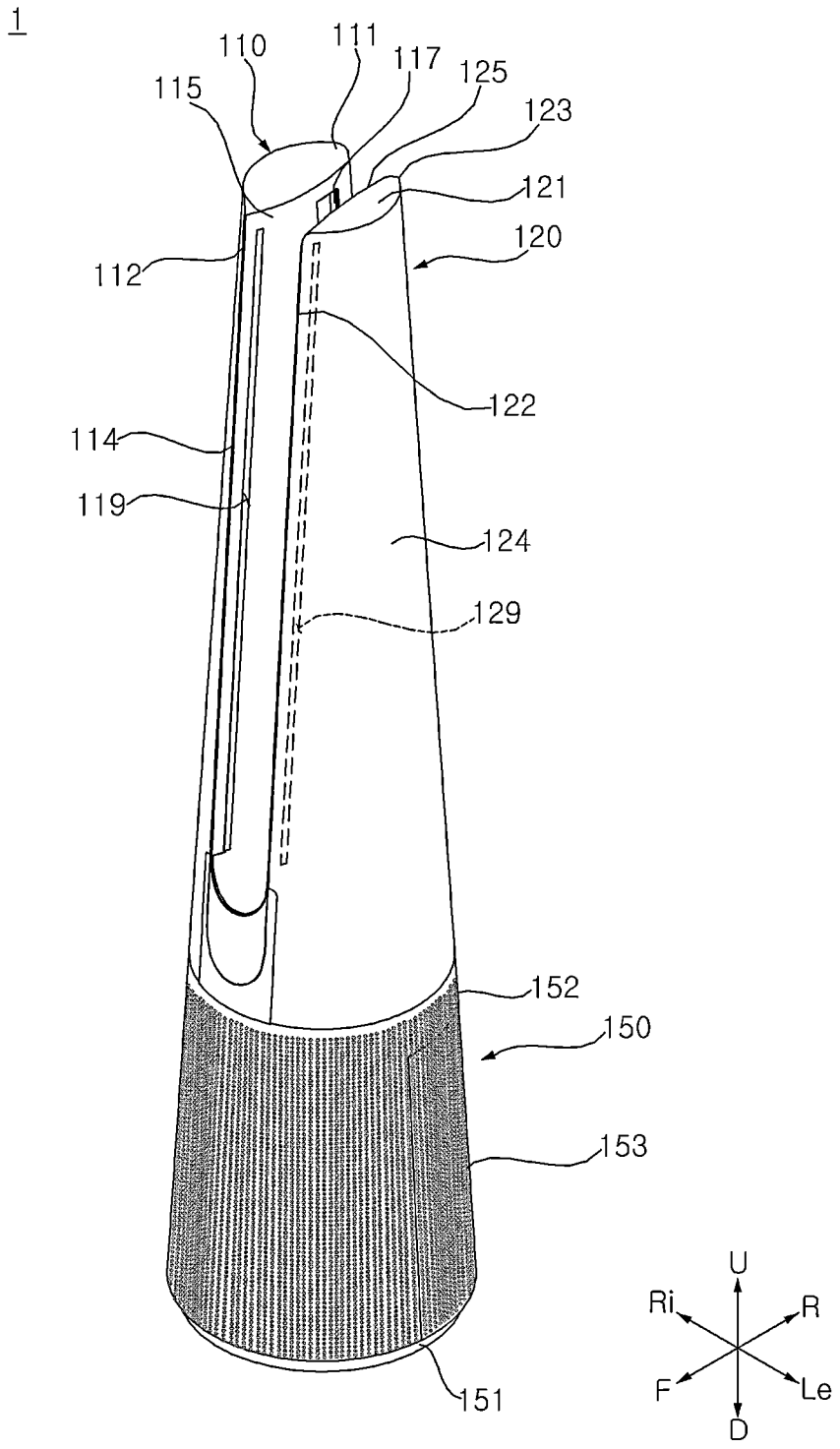
FIG. 1 is a perspective view of a blower according to a first embodiment.

The direction indications of up (U), down (D), left (Le), right (Ri), front (F), and rear (R) shown in FIG. 1 to FIG. 11, FIG. 16 and FIG. 17, and FIG. 21 are used for convenience of description and do not limit embodiments disclosed herein. Therefore, when a reference view is changed, the above direction may be set differently.

Referring to FIGS. 1 to 4, a blower 1 may include a case 100 providing an outer shape and/or defining an exterior appearance. The case 100 may include a base case 150 in which a filter 200 may be detachably installed and a tower case 140 configured to discharge air based on the Coanda effect. The base case 150 and the tower case 140 may alternatively be referred to as lower and upper cases, respectively.

The tower case 140 may include a first tower or case 110 and a second tower or case 120 that may be separated. The first and second towers 110 and 120 may extend vertically to appear as two columns. The first tower 110 may be provided at a right side (as defined by the "Ri" direction in FIG. 1), and the second tower 120 may be provided at a left side (as defined by the "Le" direction in FIG. 1).

The first tower 110 and the second tower 120 may be spaced apart in the Right-Left direction. The first and second towers 110 and 120 may have inner spaces through which air flows. A blowing space 105 may be formed between the first tower 110 and the second tower 120 in which air flowing through the first and second towers 110 and 120 is discharged.

The front, rear, and upper sides of the blowing space 105 may be opened. Upper and lower ends of the blowing space 105 may be have an equal left-right length such that a distance between the first and second towers 110 and 120 may be equal at upper and lower sides.

The tower case 140 as a whole may be formed in a truncated cone shape. Discharge ports 117 and 127 may be respectively provided in the first tower 110 and the second tower 120 to discharge air to the blowing space 105. A first discharge port 117 may be formed in the first tower 110 to discharge air flowing inside of the first tower 110, and a second discharge port 127 may be formed in the second tower 120 to discharge air flowing inside of the second tower 120.

Each of the first and second discharge ports 117 and 127 may face the blowing space 105 or otherwise be configured to discharge air into the blowing space 105. The air discharged through the first discharge port 117 or the second discharge port 127 may be discharged in a direction crossing the blowing space 105. Air discharge directions of the air discharged through the first tower 110 and the second tower 120 may be formed in a front-rear direction and an up-down direction.

Figure 2:
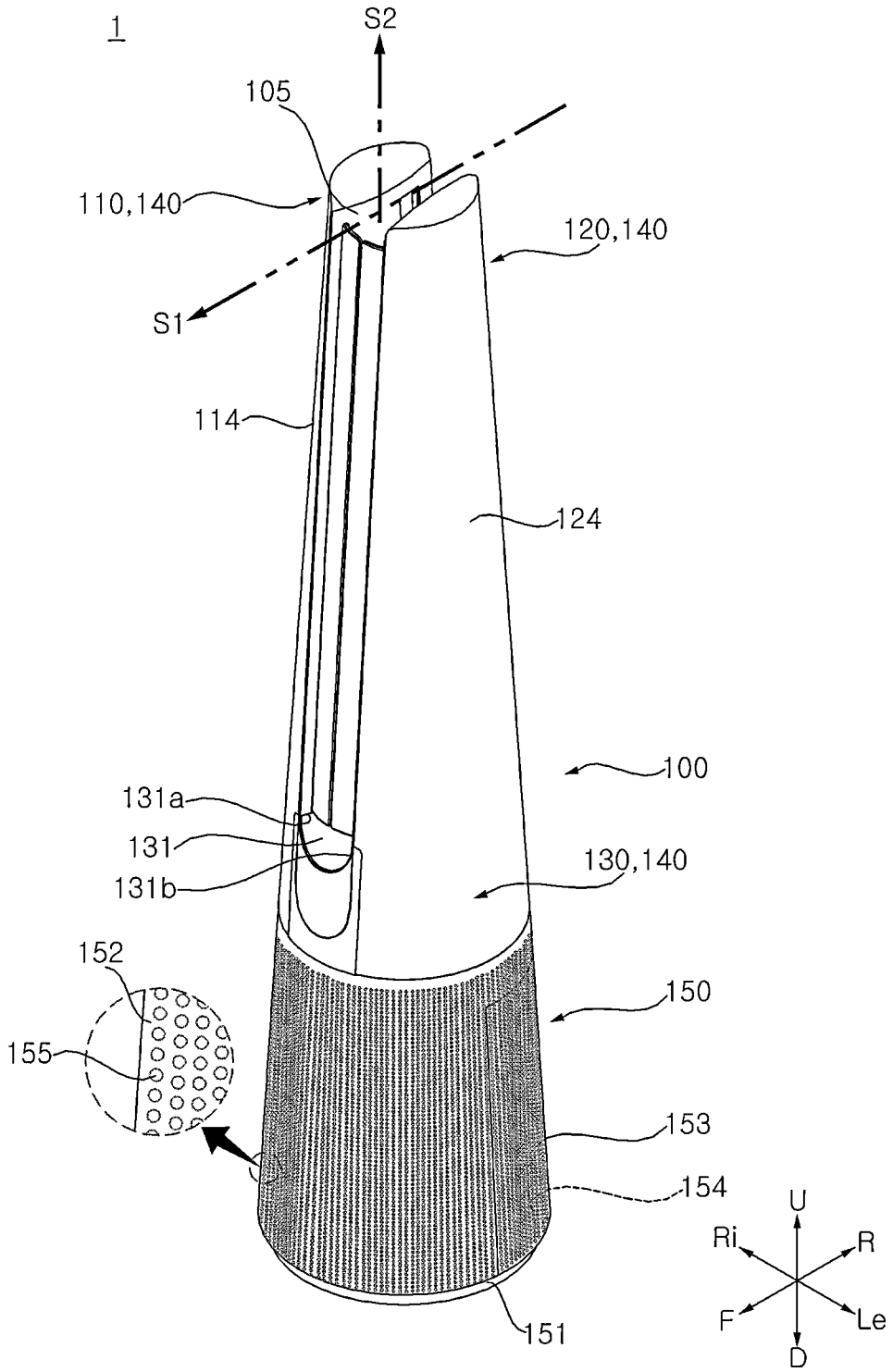
FIG. 2 is an exemplary view of the operation of FIG. 1.

Referring to FIG. 2, the air discharge direction crossing the blowing space 105 may include a first air discharge direction S1 provided in a horizontal (and front-rear) direction and a second air discharge direction S2 formed in a vertical direction. Air flowing in the first air discharge direction S1 may be defined as a horizontal airflow, and air flowing in the second air discharge direction S2 may be defined as an upward airflow.

The horizontal airflow means that the main air flow direction may be a horizontal direction and may mean that the flow rate of the air flowing in the horizontal direction may be increased. Similarly, the upward airflow means that the main air flow direction may be an upward direction and may mean that the flow rate of the air flowing in the upward direction may be increased.

Upper and lower left-right lengths of the blowing space 105 may be formed to be the same. The upper left-right length of the blowing space 105 may be a distance between an upper end of the first tower 110 and a upper end of the second tower 120. The lower left-right length of the blowing space 105 may be a distance between a lower end of the first tower 110 and a lower end of the second tower 120. Alternatively, the upper and lower lengths of the blowing space 105 may be formed to be different such that the blowing space 105 may be narrower or wider at an upper end. By forming the left-right lengths of the blowing space 105 to be uniform, however, a flow of air flowing toward a front side of the blowing space 105 may be more uniform.

For example, when the upper and lower left-right lengths of the blowing space 105 are different, a flow velocity at the end having the longer distance may be reduced, and a deviation of velocity in the vertical direction may occur. When a deviation in flow velocity occurs with respect to the vertical direction, a position where air may reach or be guided to may vary.

The air discharged from the first discharge port 117 may join or mix with the air discharged from the second discharge port 127 in the blowing space 105, and then flow in the first and second air discharge directions S1 and/or S2. The blowing space 105 may be used as a space in which discharge air streams may be joined and mixed. In addition, the air at the rear side of the blowing space 105 may also be guided through the blowing space 105 toward a front side.

The air discharged from the first discharge port 117 and the second discharge port 127 may be joined in the blowing space 105, and induced to flow in a relatively straight flow in the S1 direction. By joining the discharged air of the first discharge port 117 and the second discharge port 127 in the blowing space 105, the ambient air around the first and second towers 110 and 120 may also be indirectly guided to flow in the first and/or second air discharge directions S1 and/or S2.

Referring to FIGS. 1-2, an upper end 111 of the first tower 110 and an upper end 121 of the second tower 120 may be spaced apart to facilitate air flow in the second air discharge direction S2. The air discharged in the second air discharge direction S2 may not interfere with the case of the blower 1.

To facilitate flow in the first air discharge direction S1, a front end 112 of the first tower 110 and a front end 122 of the second tower 120 may be spaced apart, and a rear end 113 of the first tower 110 and a rear end 123 of the second tower 120 may be also spaced apart. Walls of the first tower 110 and the second tower 120 facing the blowing space 105 may be referred to as inner walls, and walls not facing the blowing space 105 may be referred to as outer walls.

Figure 4:
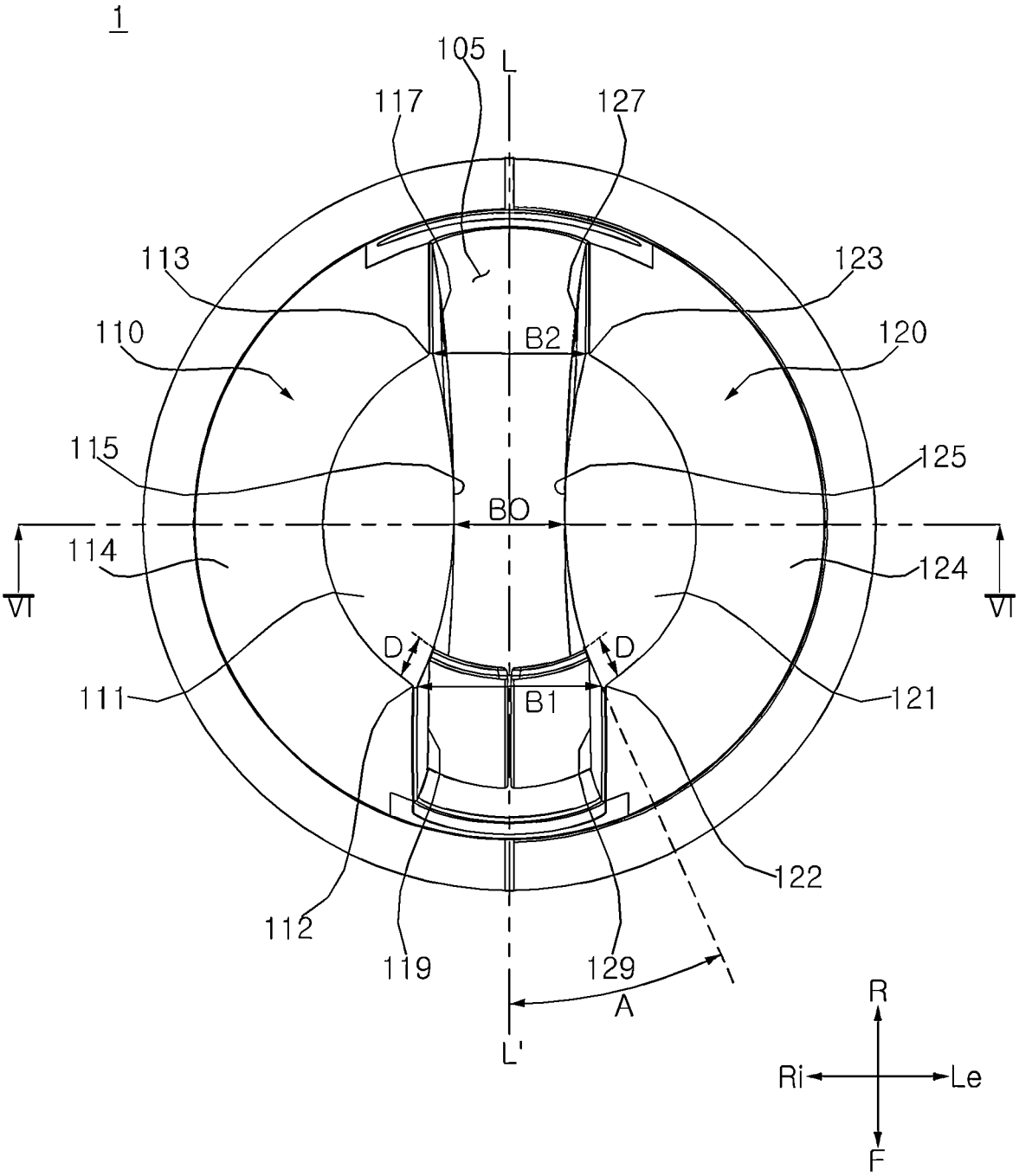
FIG. 4 is a plan view of FIG. 1.

Referring to FIG. 4, an outer wall 114 of the first tower 110 (or a first outer wall 114) and an outer wall 124 of the second tower 120 (or a second outer wall 124) may face opposite directions. The inner wall 115 of the first tower 110 (or a first inner wall 115) and the inner wall (125 of the second tower 120 (or a second inner wall 125) may face each other.

The first inner wall 115 may have a convex curvature to be curved toward the second tower 120, and the second inner wall 125 may have a convex curvature to be curved toward the first tower 110.

The first tower 110 and the second tower 120 may be formed in a streamlined shape with respect to the flow direction of air. The first inner wall 115 and the first outer wall 114 may be formed in a streamline shape to reduce drag and/or deflect air in the front-rear direction, and the second inner wall 125 and the second outer wall 124 may similarly be formed in a streamline shape to reduce drag and/or deflect air in the front-rear direction.

For example, the first inner wall 115 and the first outer wall 114 may join at the front end 112 of the first tower 110 to form an edge and also join at the rear end 113 of the first tower 110 to form an edge. An overall shape of the first tower 110 may be similar to an airplane wing. Similarly, the second inner wall 125 and the second outer wall 125 may join at the front end 122 of the second tower 120 to form an edge and also join at the rear end 123 of the second tower 120 to form an edge. An overall shape of the second tower 120 may be similar to an airplane wing.

The first discharge port 117 may be provided in the first inner wall 115, and the second discharge port 127 may be provided in the second inner wall 125. The first inner wall 115 and the second inner wall 125 may be spaced apart by a center distance B0 at a central portion 115*a* of the first inner wall 115 and a central portion 125*a* of the second inner wall 125. The center distance B0 may be a shortest or minimum distance between the first and second inner walls 115 and 125 due to a curvature of the first and second inner walls 115 and 125.

The central portion 115*a* of the first inner wall 115 may be an area located between the front end 112 and the rear end 113 of the first inner wall 115. Similarly, the central portion 125*a* of the second inner wall 125 may be an area located between the front end 122 and the rear end 123 of the second inner wall 125.

Each of the first discharge port 117 and the second discharge port 127 may be provided at a rear side of the central portion 115*a* of the first inner wall 115 and the central portion 125*a* of the second inner wall 125. The first discharge port 117 may be provided between the central portion 115*a* and the rear end 113 of the first inner wall 115. The second discharge port 127 may be provided between the central portion 125*a* and the rear end 123 of the second inner wall 125.

A distance between the front end 112 of the first tower 110 and the front end 122 of the second tower 120 may be referred to as a first distance B1 or alternatively as a front end distance B1. A distance between the rear end 113 of the first tower 110 and the rear end 123 of the second tower 120 may be referred to as a second distance B2 or alternatively as a rear end distance B2.

The first distance B1 and the second distance B2 may be longer than the center distance B0. The first distance B1 and the second distance B2 may be equal, or alternatively, different.

The first and second inner walls 115 and 125 may be collectively referred to as the inner walls 115, 125. The first and second discharge ports 117, 127 may be collectively referred to as the discharge ports 117, 127. The first and second outer walls 114 and 124 may be collectively referred to as the outer walls 114, 124. The first and second front ends 112 and 122 may collectively be referred to as the front ends 112, 122. The first and second rear ends 113 and 123 may collectively be referred to as the rear ends 113, 123.

As the discharge ports 117, 127 may be provided closer to the rear ends 113, 123, an airflow may be easier to control using the Coanda effect described in more detail later. The inner wall 115 of the first tower 110 and the inner wall 125 of the second tower 120 may be configured to facilitate a Coanda effect, and the outer wall 114 of the first tower 110 and the outer wall 124 of second tower 120 may be configured to indirectly provide a Coanda effect.

The inner walls 115, 125 may be configured to directly guide the air discharged from the discharge ports 117, 127 to the front ends 112, 122. The inner walls 115, 125 may directly facilitate a horizontal airflow of the air discharged from the discharge ports 117, 127.

Due to the air flow in the blowing space 105, indirect air flow may occur at the outer walls 114, 124 as well. The outer walls 114, 124 may be configured to induce a Coanda effect with respect to an indirect air flow and may guide such indirect air flow to the front ends 112, 122.

The left side of the blowing space may be blocked by the first inner wall 115, and the right side of the blowing space may be blocked by the second inner wall 125. The upper side of the blowing space 105 may be opened or not blocked.

An air flow guide or converter 400 (see FIGS. 7 and 11) described later may convert a horizontal airflow passing through the blowing space 105 into an upward airflow, and the upward airflow may flow to the open upper side of the blowing space 105. The upward airflow may suppress a direct flow of discharged air to a user, and may actively convect the indoor air.

In addition, a width of a stream of the discharge air may be adjusted through a flow rate of the air joined in the blowing space 105. By forming a vertical length of the first discharge port 117 and the second discharge port 127 to be much longer than the left and right widths of the center, first, and second distances B0, B1, B2, the discharged air of the first discharge port 117 and the discharged air of the second discharge port 127 may be induced to join in the blowing space 105.

Figure 3:
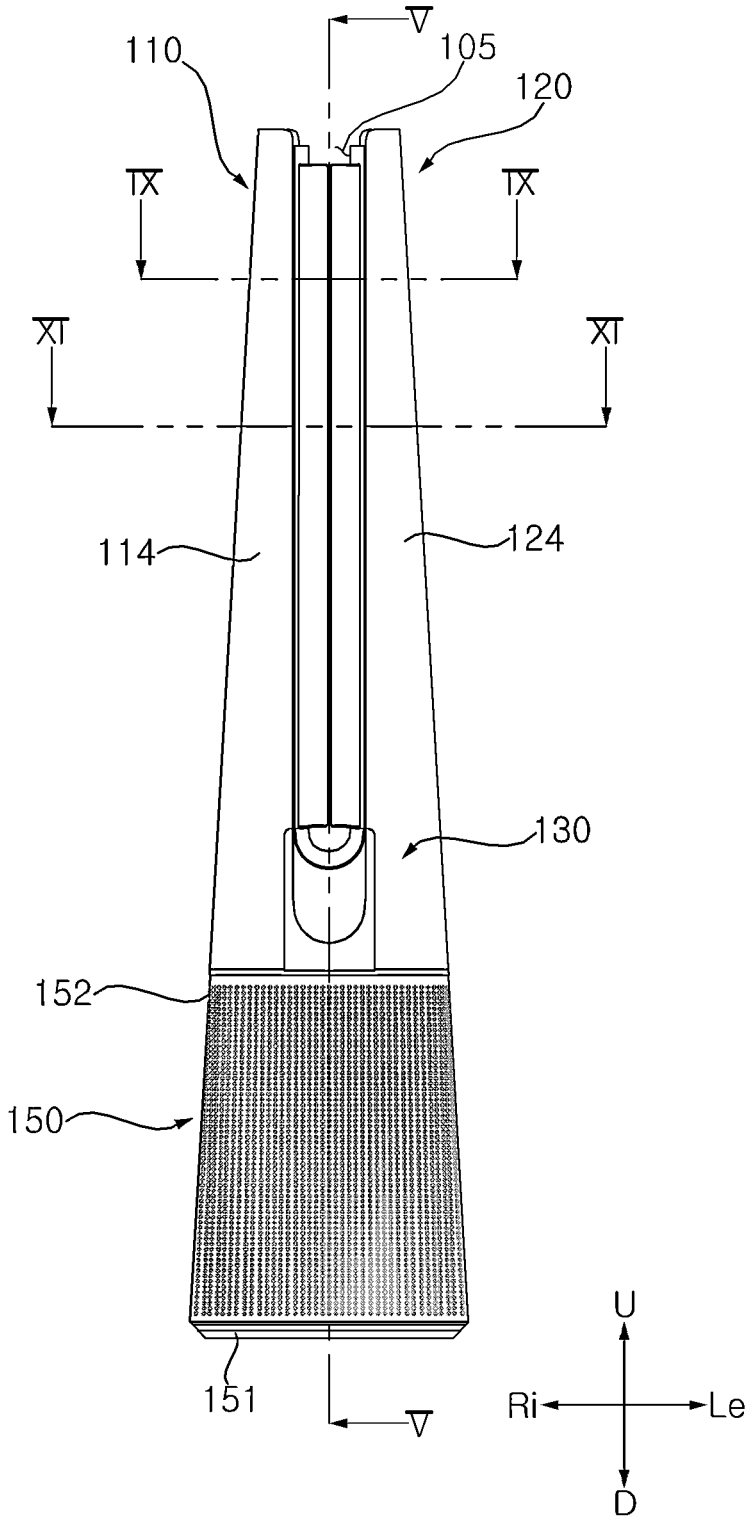
FIG. 3 is a front view of FIG. 1.

Referring to FIGS. 1 to 3, a tower base 130 may connect the first tower 110 and the second tower 120, and the tower base 130 may be assembled to the base case 150. The tower base 130 may be manufactured integrally with the first tower 110 and the second tower 120 or alternatively manufactured separately and later combined. As another alternative, the tower base 130 may be omitted, and the first tower 110 and the second tower 120 may be directly coupled to the base case 150 or may be manufactured integrally with the base case 150.

The base case 150 may form a lower portion of the blower 1, and the tower case 140 may form an upper portion of the blower 1. The blower 1 may suction ambient air from the base case 150 and discharge the filtered air in the tower case 140. The tower case 140 may discharge air from a position higher than the base case 150.

The blower 1 may have a pillar shape whose diameter decreases toward the upper portion. The blower 1 may have a conical or truncated cone shape as a whole, but embodiments disclosed herein are not limited. For example, the blower 1 may include two straight towers 110 and 120 that do not become narrower in an upward direction (e.g., straight towers). However, when a cross section of the blower 1 becomes narrower in the upward direction, a center of gravity may be lowered, reducing a risk of overturning or tipping due to external force.

For convenience of assembly, the base case 150 and the tower case 140 may be separately manufactured. Alternatively, the base case 150 and the tower case 140 may be integrally formed. For example, the base case 150 and the tower case 140 may be manufactured in the form of a front case and a rear case which may be integrally manufactured and then assembled.

The base case 150 may be formed to gradually decrease in diameter toward an upper side. The tower case 140 may be also be formed to gradually decrease in diameter toward an upper side.

Outer surfaces of the base case 150 and the tower case 140 may be formed to be continuous. A lower end of the tower base 130 and an upper end of the base case 150 may be in close contact, and an outer surface of the tower base 130 and the outer surface of the base case 150 may form a continuous surface. A lower end diameter of the tower base 130 may be the same as or slightly smaller than an upper end diameter of the base case 150.

The tower base 130 may distribute air supplied from the base case 150 and provide the distributed air to the first tower 110 and the second tower 120. The tower base 130 may connect the first tower 110 and the second tower 120. The blowing space 105 may be provided above the tower base 130.

In addition, the discharge port 117, 127 may be provided in the upper side of the tower base 130, and an upward airflow and a horizontal airflow may be formed in the upper side of the tower base 130. In order to reduce or minimize drag or friction with air, the upper surface 131 of the tower base 130 may be formed as a curved surface that curves downward to have a concave curvature that extends in the front-rear direction. Referring to FIG. 2, one or a first side 131*a* of the upper surface 131 may be connected to the first inner wall 115, and the other or a second side 131*b* of the upper surface 131 may be connected to the second inner wall 125.

Referring to FIG. 4, when viewed from a top, the first tower 110 and the second tower 120 may be vertically symmetrical with respect to a center line L-L'. The first discharge port 117 and the second discharge port 127 may be provided to be vertically symmetrical with respect to the center line L-L'.

The center line L-L' may be a virtual line between the first tower 110 and the second tower 120 and may extend in the front-rear direction. The center line L-L' may pass through the upper surface 131. Alternatively, the first tower 110 and the second tower 120 may be formed in an asymmetric shape. However, a symmetric arrangement may be advantageous in controlling a horizontal airflow and an upward airflow.

Figure 5:
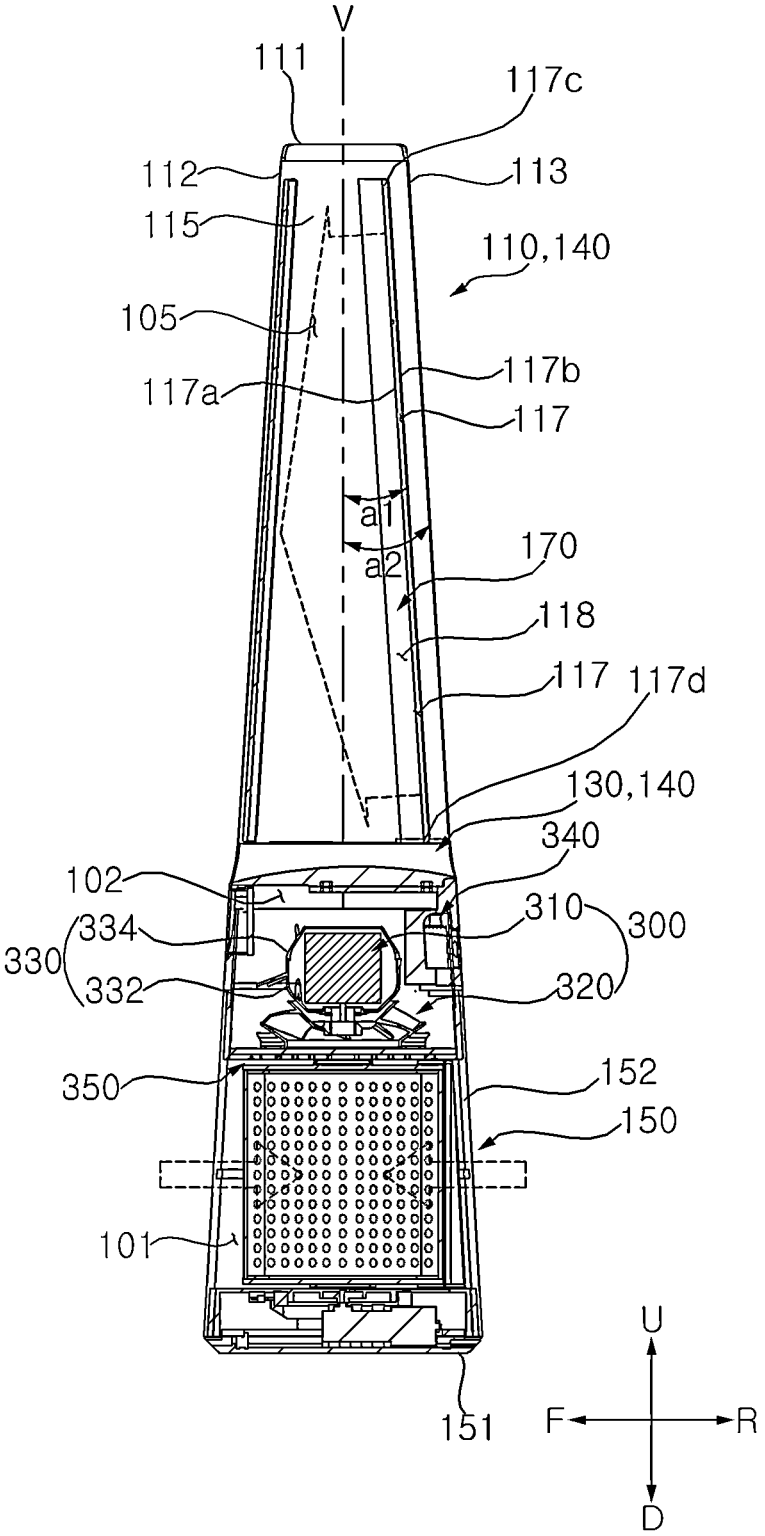
FIG. 5 is a cross-sectional view taken along line V-V of FIG. 3.
Figure 6:
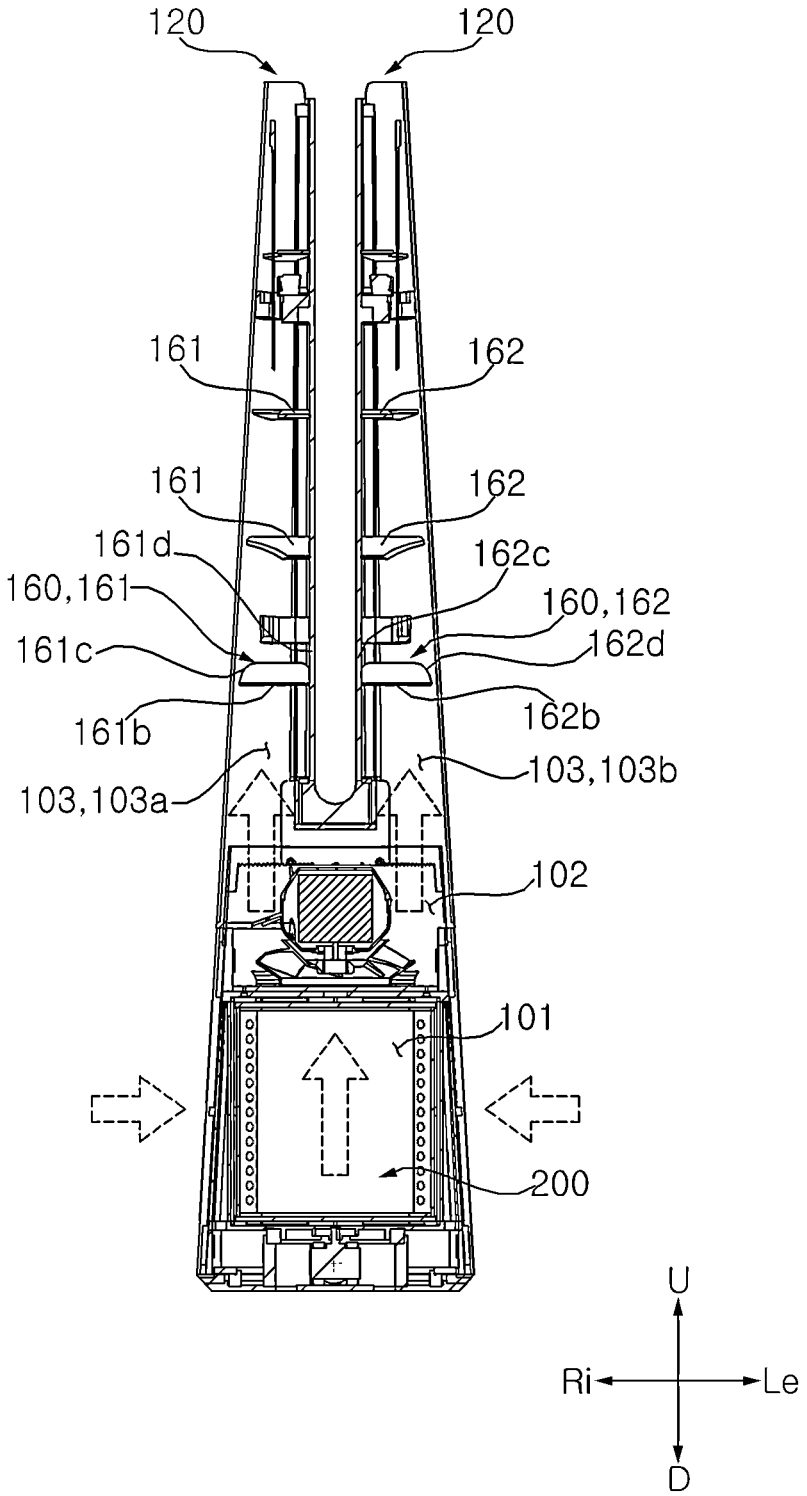
FIG. 6 is a cross-sectional view taken along line VI-VI of FIG. 4.
Figure 7:
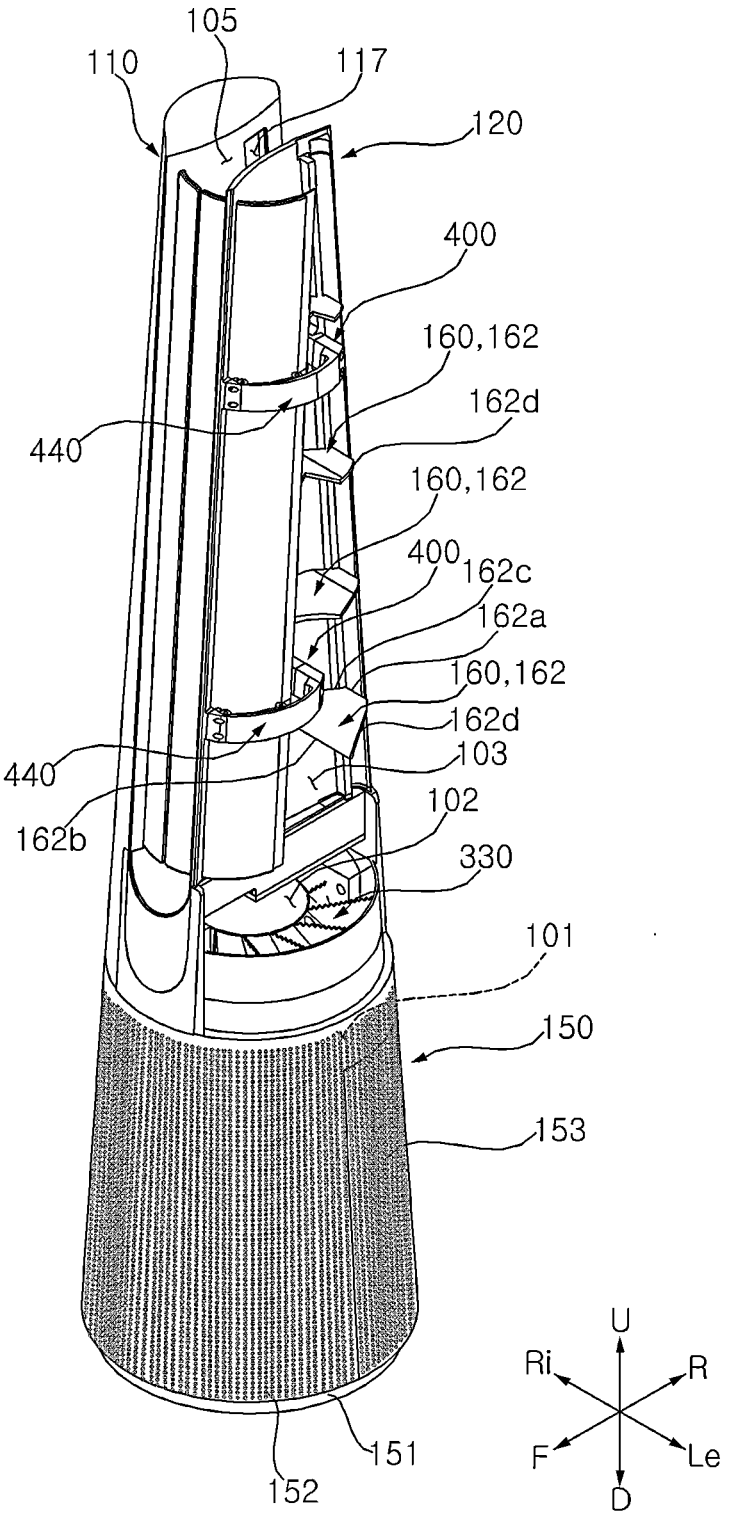
FIG. 7 is a partially exploded perspective view illustrating the interior of a second tower of FIG. 1.

Referring to FIGS. 1 and 5-6, the blower 1 may include a filter 200 provided inside the case 100 and a fan device 300 provided inside the case 100 to guide air to the discharge port 117, 127. The filter 200 and the fan device 300 may be provided inside the base case 150. The base case 150 may be formed in a truncated cone shape, and an upper side of the base case 150 may be opened.

Referring to FIG. 5, the base case 150 may include a base 151 seated on the ground and a base outer wall 152 that may be coupled to an upper side of the base 151. The base outer wall 152 may have a space formed therein and may have a suction port 155.

The base 151 may be formed in a circular shape. The base outer wall 152 may be formed in a truncated cone shape having open upper and lower sides. Referring to FIG. 2, a part of a side surface of the base outer wall 152 may be opened. An open portion of the base outer wall 152 may be referred to as a filter insertion port 154.

Referring to FIG. 2, the case 100 may include a cover 153 that blocks the filter insertion port 154. The cover 153 may be assembled to be detachable from the base outer wall 152 and the filter 200 may be held in or assembled to the cover 153. The user may separate the cover 153 and take the filter 200 out of the case 100 for cleaning, reparation, replacement, etc.

The suction port 155 may be formed in at least one of the base outer wall 152 and the cover 153. The suction port 155 may be formed in both the base outer wall 152 and the cover 153, and may suction air from all directions 360° around the case 100. The suction port 155 may be formed in a hole shape, and a shape and/or arrangement of the suction port 155 may be variously formed.

The filter 200 may be formed in a cylindrical shape having a vertical hollow space. The outer surface of the filter 200 may be provided to face the suction port 155 formed in the base outer wall 152 or the cover 153. The indoor or ambient air may pass through the filter 200 from an outside to an inside of the filter 200, and foreign substances or harmful gases in the air may be removed from the air.

The fan device 300 may be provided above the filter 200. The fan device 300 may guide the air that passed through the filter 200 to the first tower 110 and the second tower 120.

Referring to FIG. 5, the fan device 300 may include a fan motor 310 and a fan 320 rotated by the fan motor 310, and may be provided inside the base case 150.

The fan motor 310 may be provided above the fan 320, and a motor shaft of the fan motor 310 may be coupled to the fan 320 provided in the lower side. A motor housing 330 in which the fan motor 310 may be installed or located may be provided above the fan 320.

The motor housing 330 may have a shape surrounding the entire fan motor 310. Since the motor housing 330 surrounds the entire fan motor 310, a flow resistance of air flowing from a lower side to an upper side may be reduced. Alternatively, the motor housing 330 may be formed in a shape surrounding only a lower portion of the fan motor 310.

The motor housing 330 may include a lower motor housing 332 and an upper motor housing 334. At least one of the lower motor housing 332 or the upper motor housing 334 may be coupled to the case 100. After the fan motor 310 may be installed or provided in the upper side of the lower motor housing 332, the upper motor housing 334 may be covered to surround the fan motor 310. The motor shaft of the fan motor 310 may pass through the lower motor housing 332 and may be assembled to the fan 320.

The fan 320 may include a hub to which the shaft of the fan motor is coupled, a shroud spaced apart from the hub, and a plurality of blades connecting the hub and the shroud. After the air that passed through the filter 200 is suctioned into the shroud, the air may be pressurized and guided by a rotating blade. The hub may be provided at an upper side of the blade, and the shroud may be provided at a lower side of the blade. The hub may be formed in a bowl shape which has a curvature downward to be concave, and the lower side of the lower motor housing 332 may be partially inserted therein.

The fan 320 may be a mixed flow fan. The mixed flow fan may suction air into an axial center and discharges air in a radial direction. The discharged air may be formed to be inclined with respect to the axial direction. Since an entire air flow may flow from the lower side to the upper side, when air may be discharged in the radial direction like a general centrifugal fan, a large flow loss may occur due to a change of the flow direction. The mixed flow fan may reduce or minimize an air flow loss by discharging air upward in the radial direction.

A diffuser 340 may be further provided above the fan 320. The diffuser 340 may guide the air flow caused by the fan 320 in the upward direction. The diffuser 340 may further reduce a radial component of the air flow and enhance an upward air flow component.

The motor housing 330 may be provided between the diffuser 340 and the fan 320. To reduce or minimize a vertical installation height of the motor housing 330, a lower end of the motor housing 330 may be provided to be inserted into the fan 320 to overlap with the fan 320 in the vertical direction. An upper end of the motor housing 330 may be provided to be inserted into the diffuser 340 to overlap with the diffuser 340 in the vertical direction. The lower end of the motor housing 330 may be provided higher than the lower end of the fan 320, and the upper end of the motor housing 330 may be provided lower than the upper end of the diffuser 340.

To configure or optimize the installation position of the motor housing 330, the upper side of the motor housing 330 may be provided inside the tower base 130 and the lower side of the motor housing 330 may be provided inside the base case 150. The motor housing 330 may be provided inside the tower base 130 or the base case 150.

A suction grill 350 may be provided inside the base case 150. When the filter 200 may be separated, the suction grill 350 may block a user's finger from being caught in the fan 320 and may protect both the user and the fan 320.

The filter 200 may be provided at a lower side of the suction grill 350 and the fan 320 may be provided at an upper side. The suction grill 350 may have a plurality of through holes so that air may flow vertically.

A filter installation space 101 in which the filter 200 may be provided may be formed in a space of the case 100 below the suction grill 350. A flow space 102 through which air flows between the suction grill 350 and the discharge port 117, 127 may be formed inside the case 100.

Referring to FIG. 6, a discharge space 103 may be formed inside the first tower 110 and the second tower 120 to facilitate an upward air flow toward the first discharge port 117 and/or the second discharge port 127. The flow space 102 may include the discharge space 103. The ambient or indoor air may be introduced into the filter installation space 101 through the suction port 155 and then discharged to the discharge ports 117, 127 through the flow space 102 and the discharge space 103.

Referring to FIGS. 5 to 8, an air guide 160 to convert a flow direction of air toward a horizontal direction may be provided in the discharge space 103. A plurality of air guides 160 may be provided. The air guide 160 may guide air flowing in a vertical direction toward the discharge ports 117, 127 outward to flow in a horizontal direction. The air guide 160 may alternatively be referred to as a vane or louver.

The air guide 160 may include a first air guide 161 provided inside the first tower 110 and a second air guide 162 provided inside the second tower 120. Referring to FIG. 6, the first air guide 161 may be coupled to an inner wall and/or an outer wall of the first tower 110. The first air guide 161 may be provided such that a front side end 161*a* may be close to the first discharge port 117 and a rear side end 161*b* may be spaced apart from the rear end 113 of the first tower 110.

To guide the air flowing from the lower side to the first discharge port 117, the first air guide 161 may be formed to have a convex curved surface from a lower side to tan upper side. The rear side end 161*b* may be provided lower than the front side end 161*a*.

At least a portion of a left side end 161*c* of the first air guide 161 may be in close contact with or coupled to the left wall of the first tower 110. At least a portion of a right side end 161*d* of the first air guide 161 may be in close contact with or coupled to the right wall of the first tower 110. Air moving upward along the discharge space 103 may flow from the rear end of the first air guide 161 to the front end of the first air guide 161.

Figure 8:
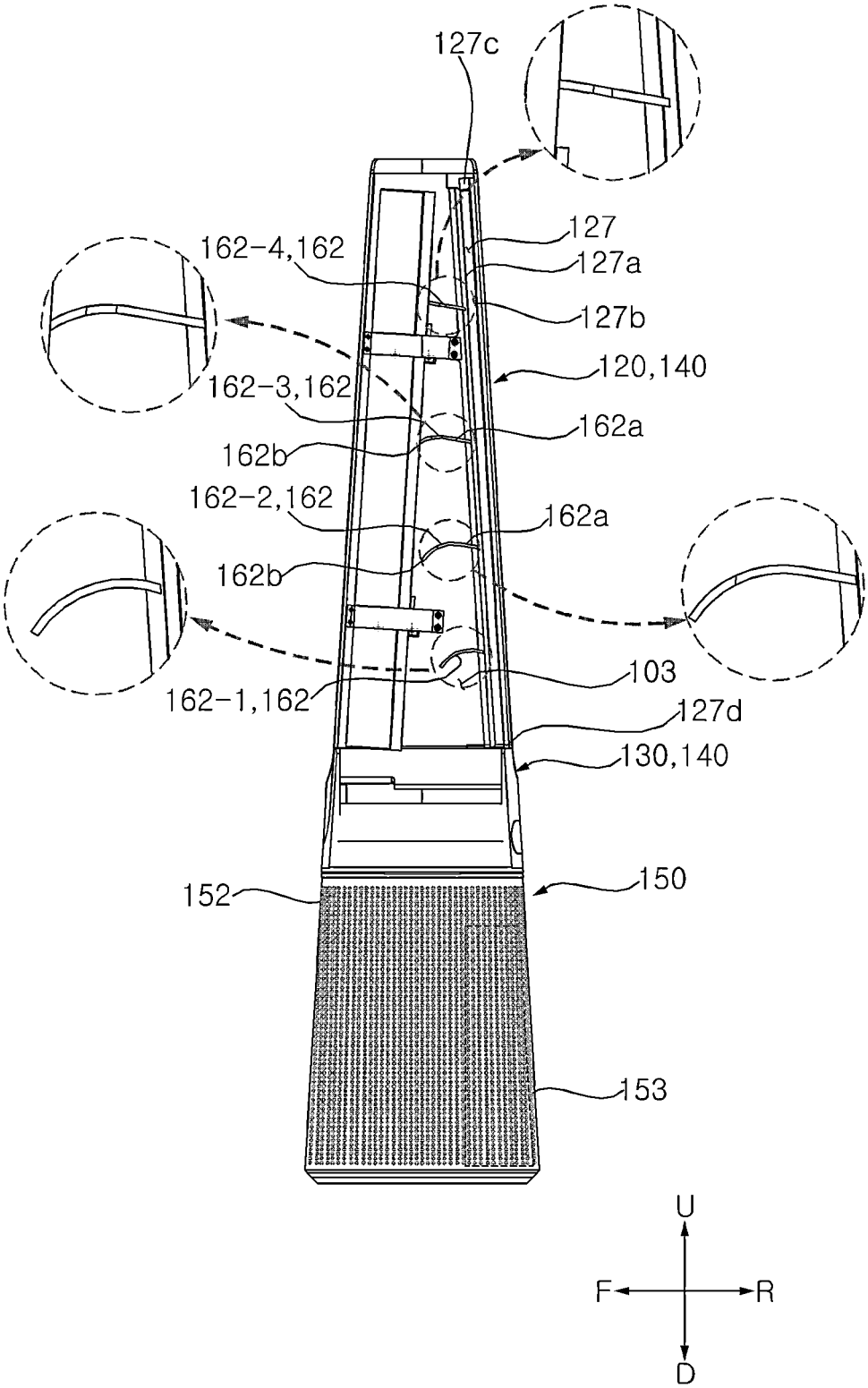
FIG. 8 is a right side view of FIG. 7.

The second air guide 162 may be vertically symmetrical to the first air guide 161. The second air guide 162 may be coupled to an inner wall and/or an outer wall of the second tower 110. Referring to FIG. 8, a front side end 162*a* of the second air guide 162 may be close to the second discharge port 127, and a rear side end 162*b* may be spaced apart from the rear end of the second tower 120.

To guide the air flowing from the lower side to the second discharge port 127, the second air guide 162 may be formed to have a convex curved surface from a lower side to an upper side. The rear side end 162*b* may be provided lower than the front side end 162*a*.

Referring back to FIG. 6, at least a portion of a left side end 162*c* of the second air guide 162 may be in close contact with or coupled to the left wall of the second tower 120. At least a portion of a right side end 162*d* of the second air guide 162 may be in close contact with or coupled to the right wall of the first tower 110.

Referring to FIGS. 5 and 8, the first discharge port 117 and the second discharge port 127 may extend in the vertical direction. The first discharge port 117 may be provided between the front end 112 and the rear end 113 of the first tower 110 at a position closer to the rear end 113 than the front end 112. The air discharged from the first discharge port 117 may flow along the first inner wall 115 due to the Coanda effect. The air flowing along the first inner wall 115 may flow toward the front end 112.

Referring to FIG. 5, the first discharge port 117 may include a first border or edge 117*a* forming an edge of an air discharge side (a front end in FIG. 5), a second border or edge 117*b* forming an edge of an opposite side (a rear end in FIG. 5) to the air discharge side, an upper border or edge 117*c* forming an upper edge of the first discharge port 117, and a lower border or edge 117*d* forming a lower edge of the first discharge port 117. The first border 117*a* and the second border 117*b* may be parallel to each other. The upper border 117*c* and the lower border 117*d* may be parallel to each other.

The first border 117*a* and the second border 117*b* may be inclined with respect to the vertical direction V. The rear end 113 of the first tower 110 may be also provided to be inclined with respect to the vertical direction V.

The inclination a1 of the discharge port 117 may be greater than the inclination a2 of the outer surface of the tower 110. Referring to FIG. 5, the inclination a1 of the first border 117*a* and the second border 117*b* with respect to the vertical direction V may be formed to be 4 degrees, and the inclination a2 of the rear end 113 may be formed to be 3 degrees. As an alternative, the inclinations a1 and a2 may be the same. The second discharge port 127 may be formed to be vertically symmetrical with the first discharge port 117.

Referring to FIG. 8, the second discharge port 127 may include a first border or edge 127*a* forming an edge of the air discharge side (a front end in FIG. 8), a second border or edge 127*b* forming an edge of the opposite side (a rear end in FIG. 8) to the air discharge side, an upper border or edge 127*c* forming an upper edge of the second discharge port 127, and a lower border or edge 127*d* forming a lower edge of the second discharge port 127.

Figure 9:
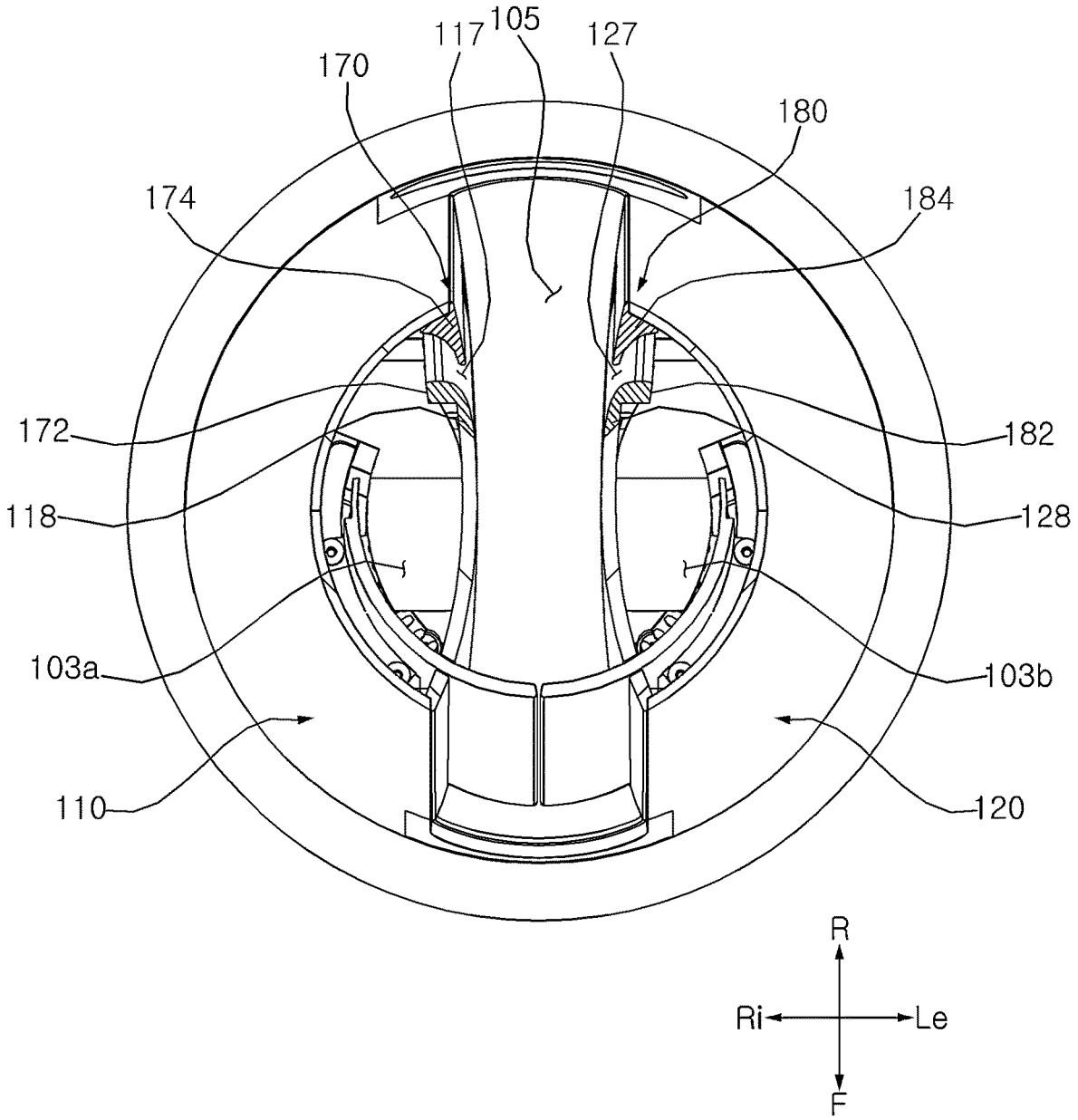
FIG. 9 is a cross-sectional view taken along line IX-IX of FIG. 3.

Referring to FIG. 9, the first discharge port 117 of the first tower 110 may face the second tower 120, and the second discharge port 127 of the second tower 120 may face the first tower 110. The air discharged from the first discharge port 117 may flow along the inner wall 115 of the first tower 110 through the Coanda effect. The air discharged from the second discharge port 127 flows along the inner wall 125 of the second tower 120 through the Coanda effect.

The blower 1 further may include a first discharge case 170 and a second discharge case 180. The first discharge port 117 may be formed in the first discharge case 170. The first discharge case 170 may be assembled or coupled to the first tower 110. The second discharge port 127 may be formed in the second discharge case 180. The second discharge case 180 may be assembled or coupled to the second tower 120.

The first discharge case 170 may be installed to penetrate the inner wall 115 of the first tower 110 and/or to be provided between the inner and outer walls 115 and 114 of the first tower 110. The second discharge case 180 may be installed to penetrate the inner wall 125 of the second tower 120 and/or to be provided between the inner and outer walls 125 and 124 of the second tower 120. The first discharge case 170 may have a first discharge opening 118 for the first tower 110, and the second discharge case 180 may have a second discharge opening 128 for the second tower 120.

The first discharge case 170 may include a first discharge guide 172 and second discharge guide 174 which form the first discharge port 117. The first discharge guide 172 may be provided at an air discharge side of the first discharge port 117. The second discharge guide 174 may be provided at an opposite side of the air discharge side of the first discharge port 117.

Figure 10:
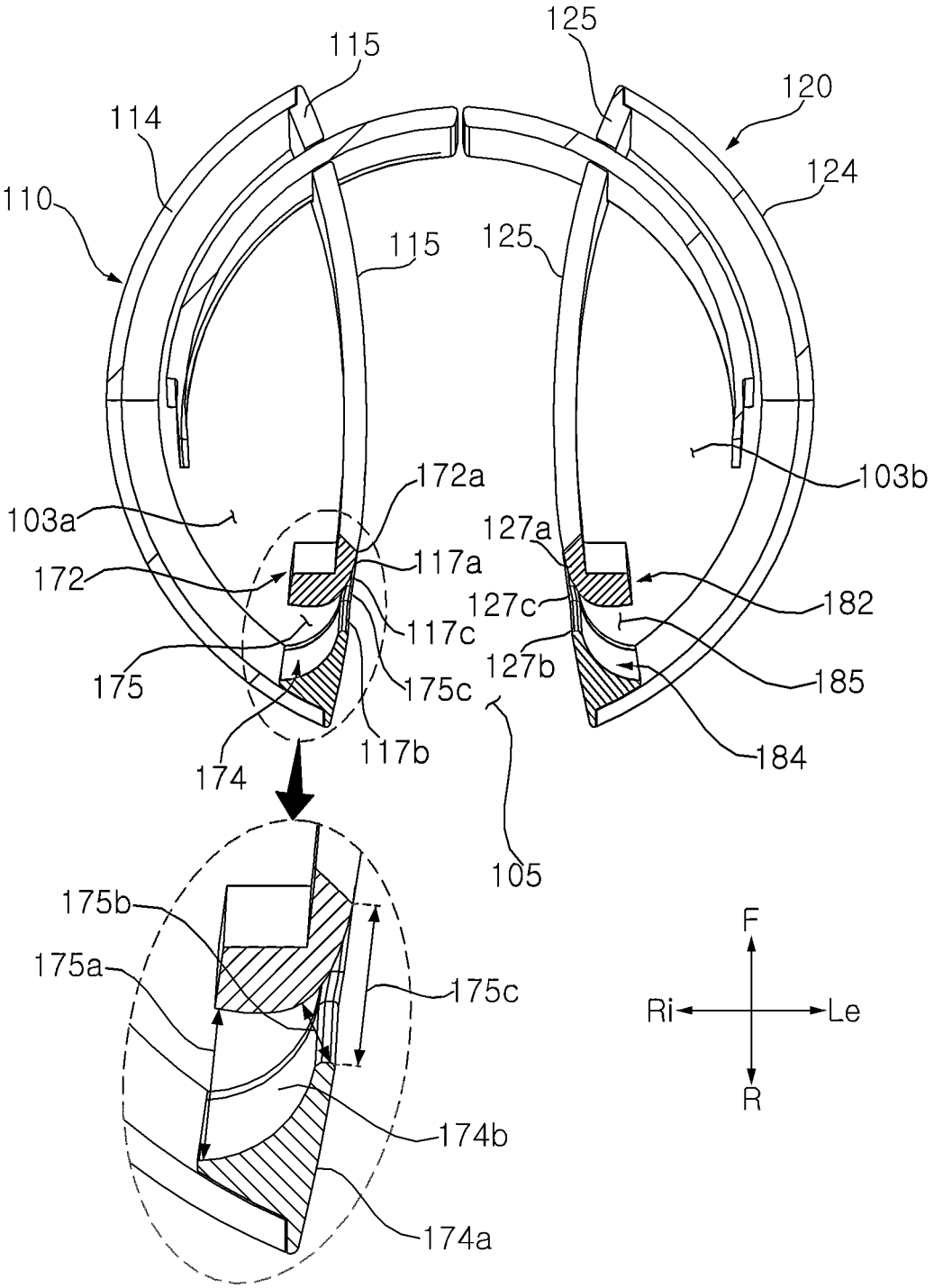
FIG. 10 is a cross-sectional view taken along line X-X in FIG. 3.

Referring to FIG. 10, outer surfaces 172*a* and 174*a* of the first discharge guide 172 and the second discharge guide 174 may define a portion of the inner wall 115 of the first tower 110. An inner side of the first discharge guide 172 may face the first discharge space 103*a*, and an outer side of the first discharge guide 172 may face the blowing space 105. An inner side of the second discharge guide 174 may face the first discharge space 103*a*, and an outer side of the second discharge guide 174 may face the blowing space 105.

The outer surface 172*a* of the first discharge guide 172 may be formed in a curved surface to provide a surface continuous to an outer surface of the first inner wall 115. The outer surface 174*a* of the second discharge guide 174 may provide a surface continuous to the first inner wall 115. The inner surface 174*b* of the second discharge guide 174 may be formed as a curved surface continuous to the inner surface of the first outer wall 115 and guide the air in the first discharge space 103*a* into the blowing space 105 with the first discharge guide 172. The first discharge port 117 may be formed between the first discharge guide 172 and the second discharge guide 174, and the air in the first discharge space 103*a* may be discharged to the blowing space 105 through the first discharge port 117.

The air in the first discharge space 103*a* may be discharged between the outer surface 172*a* of the first discharge guide 172 and the inner surface 174*b* of the second discharge guide 174. A discharge channel 175 through which air may be discharged may be formed between the outer surface 172*a* of the first discharge guide 172 and the inner surface 174*b* of the second discharge guide 174.

In the discharge channel 175, a width of a middle portion 175*b* may be formed narrower in comparison with an inlet 175*a* and an outlet 175*c*. At the middle portion 175*b*, a distance between the second border 117*b* and the outer surface 172*a* of the first discharge guide 172 may be shortest.

Referring to FIG. 10, a cross-sectional area may gradually narrow from the inlet of the discharge channel 175 to the middle portion 175*b*, and to cross-sectional area may be widened again from the middle portion 175*b* to the outlet 175*c*. The middle portion 175*b* may be located inside the first tower 110. When viewed from the outside, the outlet 175*c* of the discharge channel 175 may be seen as the discharge port 117.

To induce the Coanda effect, a radius of curvature of the inner surface 174*b* of the second discharge guide 174 may be formed to be larger than a radius of curvature of the outer surface 172*a* of the first discharge guide 172. A center of curvature of the outer surface 172*a* of the first discharge guide 172 may be located in front of the outer surface 172*a* and may be formed inside the first discharge space 103*a*. A center of curvature of the inner surface 174*b* of the second discharge guide 174 may be located in the first discharge guide 172 side and may be formed inside the first discharge space 103*a*.

Referring to FIG. 10, the second discharge case 180 may include a first discharge guide 182 and a second discharge guide 184 which form the second discharge port 127. The first discharge guide 182 may be provided at an air discharge side of the second discharge port 127, and the second discharge guide 184 may be provided at an opposite side of the air discharge side of the second discharge port 127. A discharge channel 185 may be formed between the first discharge guide 182 and the second discharge guide 184. Since the second discharge case 180 may be vertically symmetrical with the first discharge case 170, a detailed description will be omitted.

Referring to FIGS. 4, 9, 10, and 18, an airflow width due to the Coanda effect will be described in more detail. Referring to FIG. 4, the air discharged from the first discharge port 117 may flow to the first front end 112 along the first inner surface 115, and the air discharged from the second discharge port 127 may flow to the second front end 122 along the second inner surface 125.

The center distance B0 of the first inner wall 115 and the second inner wall 125 may be configured or predetermined to facilitate an intensive discharge of air forward through the Coanda effect. As the center distance B0 may be increased, the Coanda effect may become weaker, but the blowing space 105 may be wider. As the center distance B0 may be decreased, the Coanda effect may become stronger, but the blowing space 105 may be narrower.

The center distance B0 may range from 20 millimeters (mm) to 30 mm. An airflow width (left and right width) of 1.2 meters (m) may be maintained at a distance of 1.5 m in front of the front end 112, 122. A discharge angle A of the first inner wall 115 and the second inner wall 125 may be designed to limit a left-right diffusion range of discharge air. Referring briefly to FIG. 4, the discharge angle A may be defined as an angle between the center line L-L' and a tangent line formed at the front end 112, 122 of the inner wall 115, 125.

As the discharge angle A becomes smaller, the airflow width (in the left and right direction) of the discharged air becomes narrow. As the discharge angle A becomes larger, the airflow width of the discharged air becomes wider. The discharge angle A may range from 11.5 degrees to 30 degrees. When the discharge angle A is less than 11.5 degrees, the airflow width of the discharge air may be very narrow, and when the discharge angle A exceeds 30 degrees, forming a concentrated airflow in a discharge area may be difficult.

The blower 1 may further include an air flow guide or converter 400 that converts or changes an air flow direction of the air in the blowing space 105. The air flow converter 400 may convert a horizontal airflow flowing through the blowing space 105 into an upward airflow. The air flow converter 400 may serve as a damper.

Figure 11:
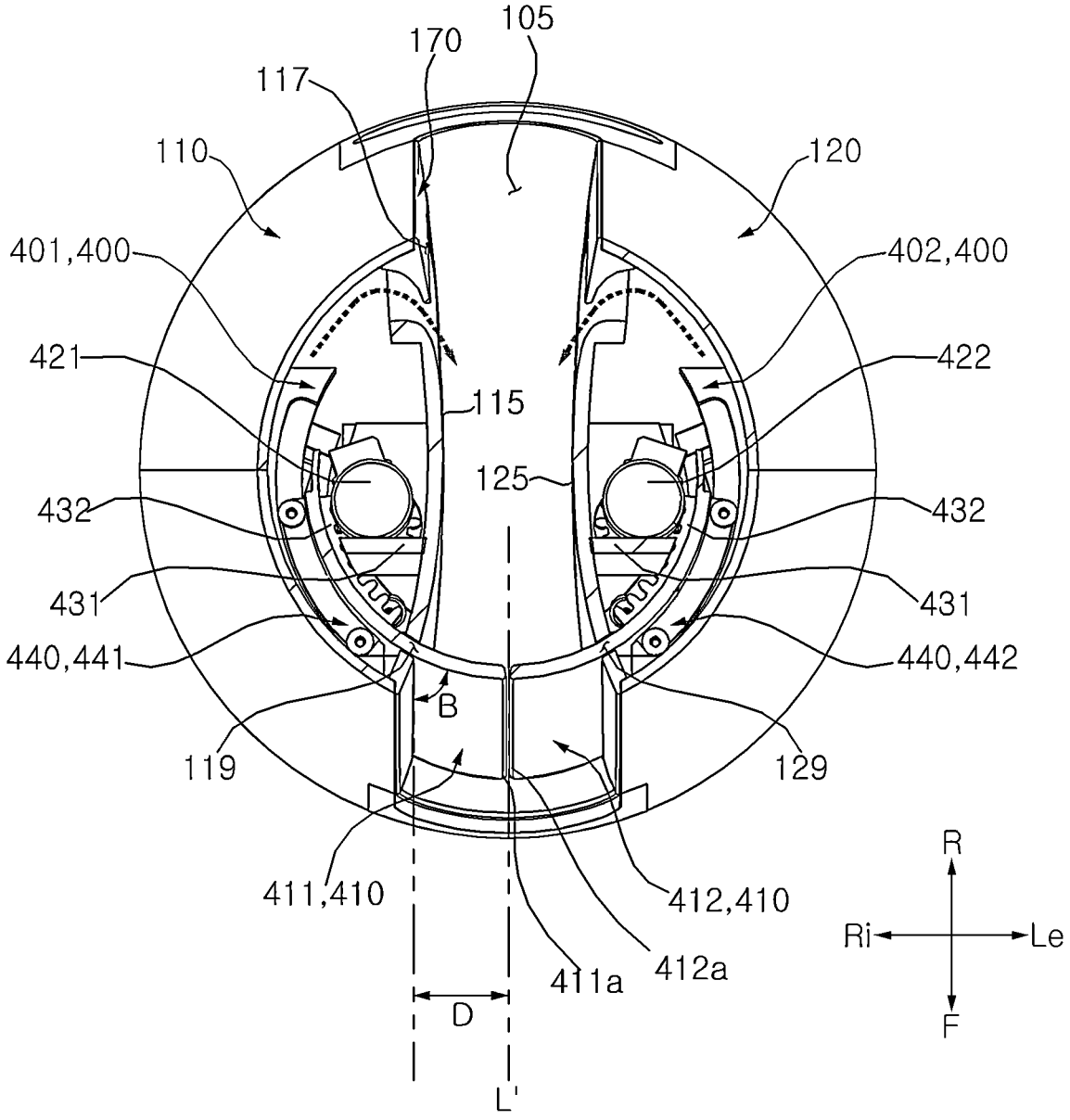
FIG. 11 is a cross-sectional view taken along XI-XI of FIG. 3.
Figure 12:
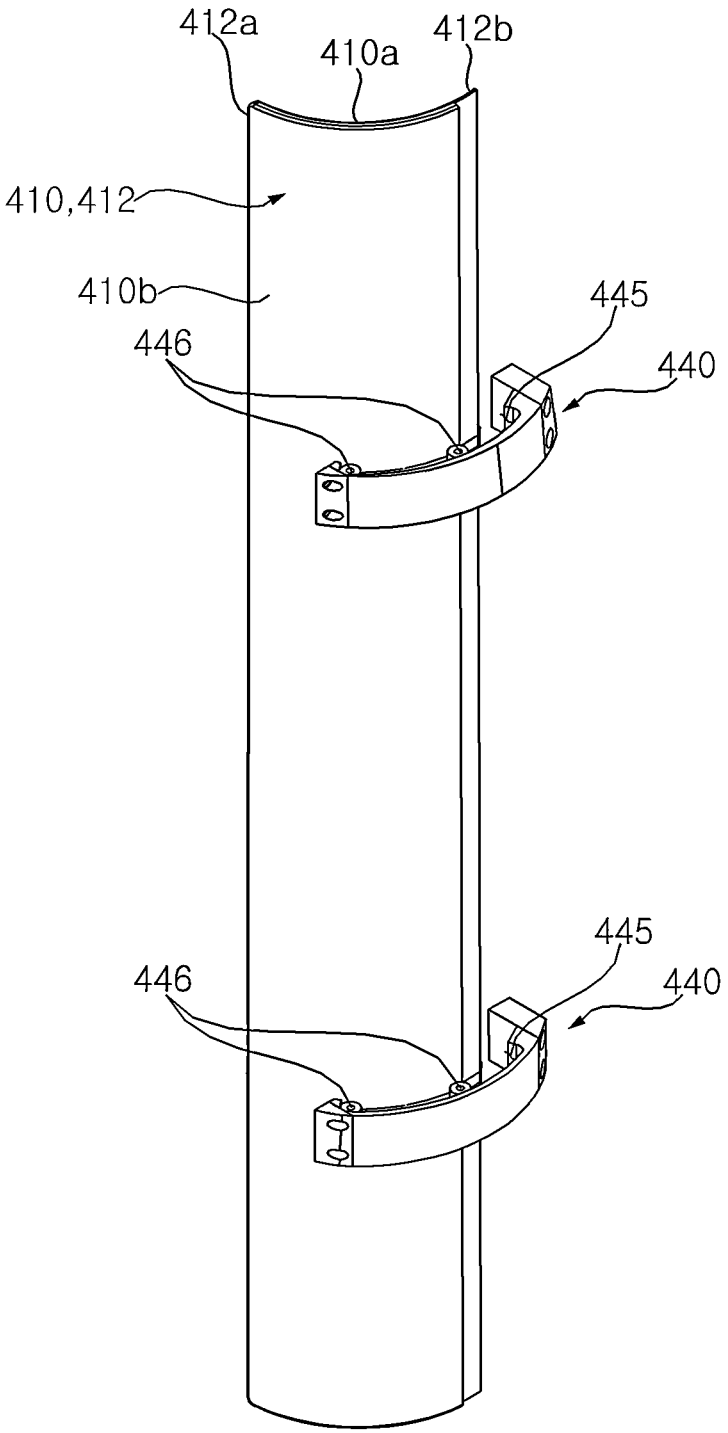
FIG. 12 is a perspective view of an air flow converter shown in FIG. 7.

Referring to FIG. 11, the air flow converter 400 may include a first air flow converter 401 provided in the first tower 110 and a second air flow converter 402 provided in the second tower 120. The first air flow converter 401 and the second air flow converter 402 may be vertically symmetrical and may have the same or a similar configuration.

The air flow guide or converter 400 may include an air flow gate 410. The air flow gate 410 may be a vertically oriented board or louver, and may be referred to simply as a gate. The gate 410 may include a first gate or board 411 for the first air flow converter 401 and a second gate or bard 412 for the second air flow converter 402. The gate 410 may be provided in the tower 110, 120. The gate 410 may be moved to protrude into the blowing space 105 to close a front opening of the blowing space 105 and guide airflow upward.

To move the gate 410, the air flow converter 400 may include a guide motor 420 which provides a driving force for a movement of the gate 410, a gear device or gear 430 which provides a driving force of the guide motor 420 to the gate 410, and a gate guider 440 which may be provided inside the tower 110, 120 and guide the movement of the gate 410. The gate 410 may be concealed or inserted inside the tower 110, 120 and/or may be withdrawn to protrude into the blowing space 105, depending on a movement and setting of the gate 410.

The air flowing through the blowing space 105 may flow from the first discharge port 117 or the second discharge port 127 to the front of the blowing space 105. The gate 410 may be provided downstream of the first discharge port 117 and the second discharge port 127 with respect to air flowing through the blowing space 105.

The first gate 411 may be provided inside the first tower 110 and may selectively protrude to the blowing space 105. The second gate 412 may be provided inside the second tower 120 and may selectively protrude to the blowing space 105.

A first board or gate slit 119 may be formed in the inner wall 115 of the first tower 110 and a second board slit 129 may be formed in the inner wall 125 of the second tower 120. The first board slit 119 and the second board slit 129 may be provided to be vertically symmetrical. The first board slit 119 and the second board slit 129 may be formed to extend long in the vertical direction. The first board slit 119 and the second board slit 129 may be provided to be inclined with respect to the vertical direction V.

The inner end 411*a* of the first gate 411 may be exposed to the first board slit 119, and the inner end 412*a* of the second gate 412 may be exposed to the second board slit 129. When the first gate 411 may be provided inside the first tower 110, the inner end 411*a* of the first gate 411 may be provided not to protrude from the inner wall 115. When the second gate 412 may be provided inside the second tower 120, the inner end 412*a* of the second gate 412 may be provided not to protrude from the inner wall 115. The front of the blowing space 105 may be opened, and air may flow horizontally in a front-rear direction when the first and second gates 411 and 412 do not protrude into the blowing space 105.

Each of the first board slit 119 and the second board slit 129 may be provided to be more inclined than the front end 112 of the first tower 110 or the front end 122 of the second tower 120 based on the vertical direction. For example, the front end 112 of the first tower 110 may be formed with an inclination of 3 degrees, and the first board slit 119 may be formed with an inclination of 4 degrees. Similarly, the front end 122 of the second tower 120 may be formed with an inclination of 3 degrees, and the second board slit 129 may be formed with an inclination of 4 degrees.

The first gate 411 may be parallel to the first board slit 119, and the second gate 412 may be parallel to the second board slit 129. The gate 410 may be formed in a flat or curved plate shape. The gate 410 may extend in the vertical direction and may be provided in front of the blowing space 105 when protruded into the blowing space 105.

When moved into the blowing space 105, the gate 410 may block a horizontal airflow flowing to the blowing space 105, and the air may be guided upward. The inner end 411*a* of the first gate 411 and the inner end 412*a* of the second gate 412 may be in contact with or close to each other to guide an upward airflow. Alternatively, there may be only one gate 410 that moves toward an opposite tower 110 or 120 to contact the tower 110 or 120 to block a front of the blowing space and facilitate an upward airflow.

Figure 16:
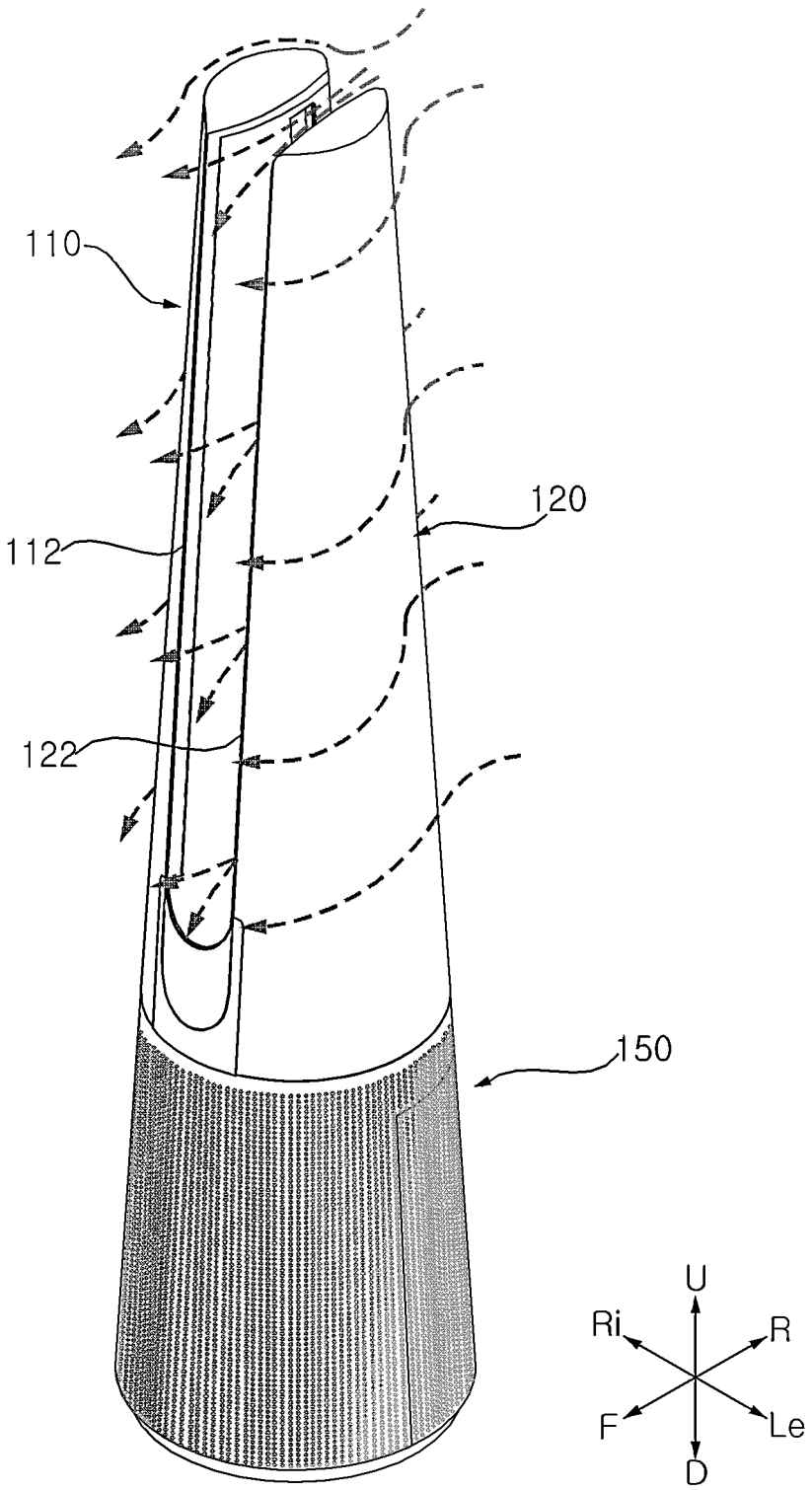
FIG. 16 is an exemplary view illustrating a horizontal airflow of a blower according to the first embodiment.

Referring to FIG. 16, during a horizontal airflow, the inner end 411*a* of the first gate 411 may close the first board slit 119, and the inner end 412*a* of the second gate 412 may close the second board slit 129. The first and second gates 411 and 412 may be concealed to be inside of the first and second towers 110 and 120, respectively.

Figure 17:
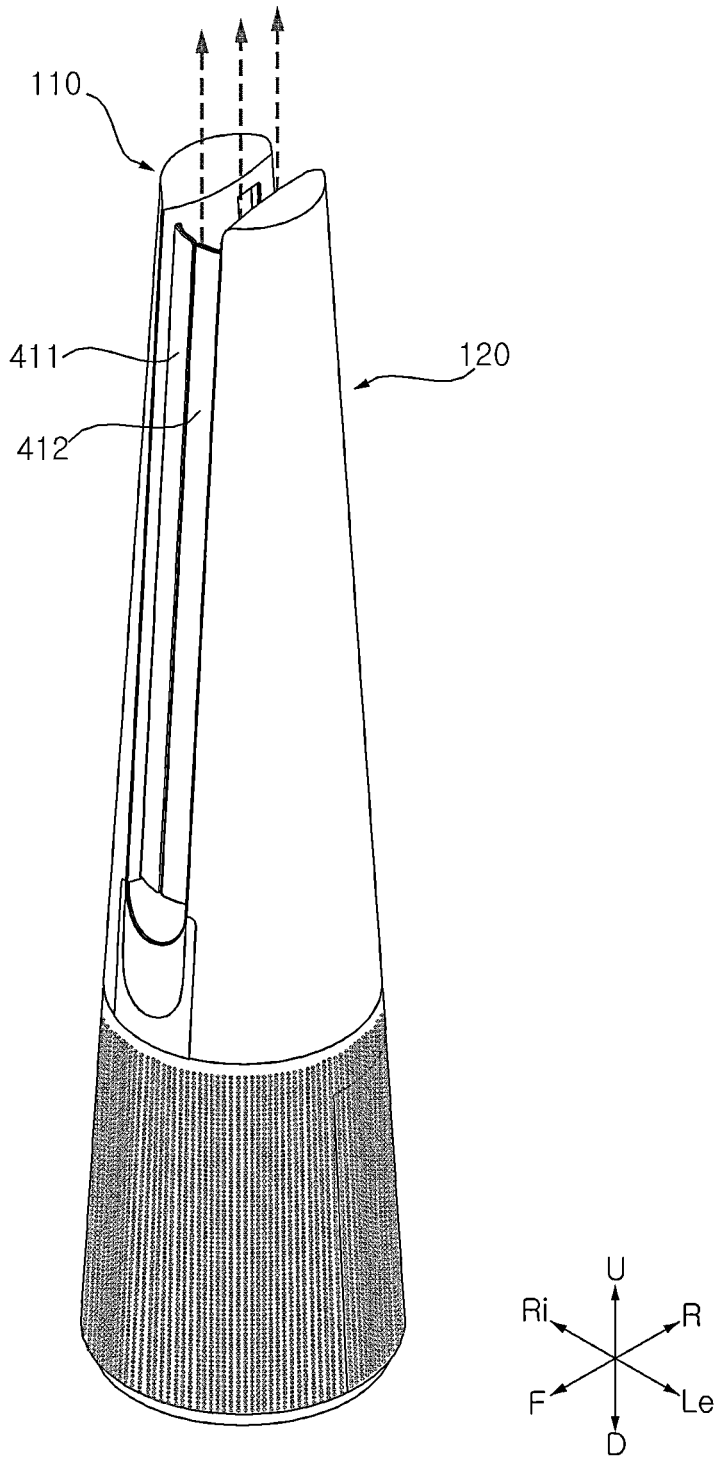
FIG. 17 is an exemplary view illustrating an upward airflow of a blower according to the first embodiment.
Figure 18:
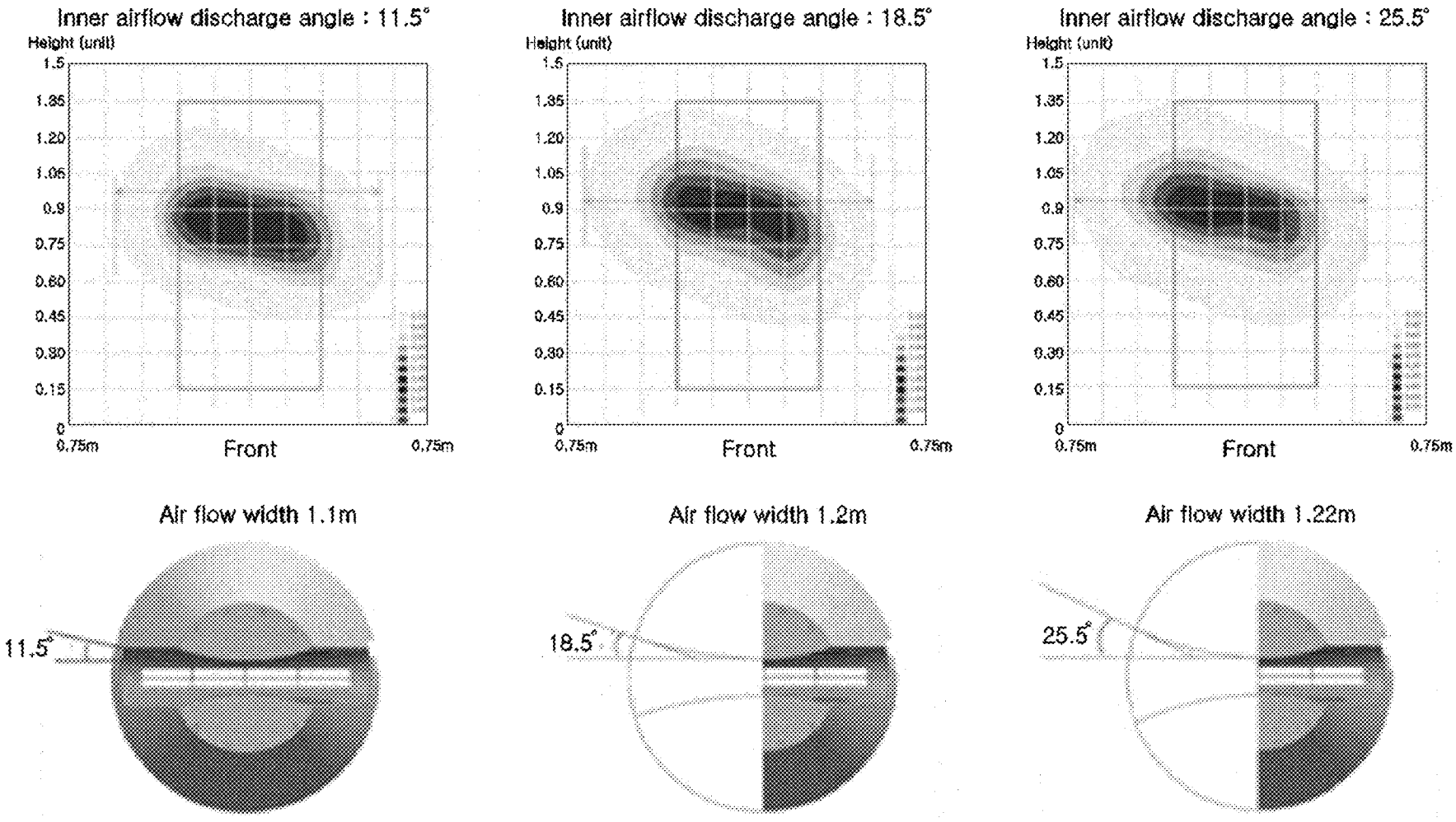
FIG. 18 is an exemplary view showing a wide airflow of a blower according to the first embodiment.

Referring to FIG. 17, when the inner end 411*a* of the first gate 411 passes through the first board slit 119 and protrudes to the blowing space 105, and the inner end 412*a* of the second gate 412 passes through the second board slit 129 and protrudes to the blowing space 105, the front of the blowing space 105 may be blocked, and air may be guided upward.

As the first gate 411 closes the first board slit 119, air in the first discharge space 103*a* may be prevented from leaking or flowing into the first board slit 119. As the second gate 412 closes the second board slit 129, air in the second discharge space 103*b* may be prevented from leaking or flowing into the second board slit 129.

The first gate 411 and the second gate 412 may protrude to the blowing space 105 by a rotating operation. Alternatively, at least one of the first gate 411 and the second gate 412 may linearly move in a slide manner to protrude to the blowing space 105.

Referring to FIG. 11, the first gate 411 and the second gate 412 may be formed in an arc shape. The first gate 411 and the second gate 412 may form a certain radius of curvature, and a center of curvature may be provided in the blowing space 105.

Figure 14:
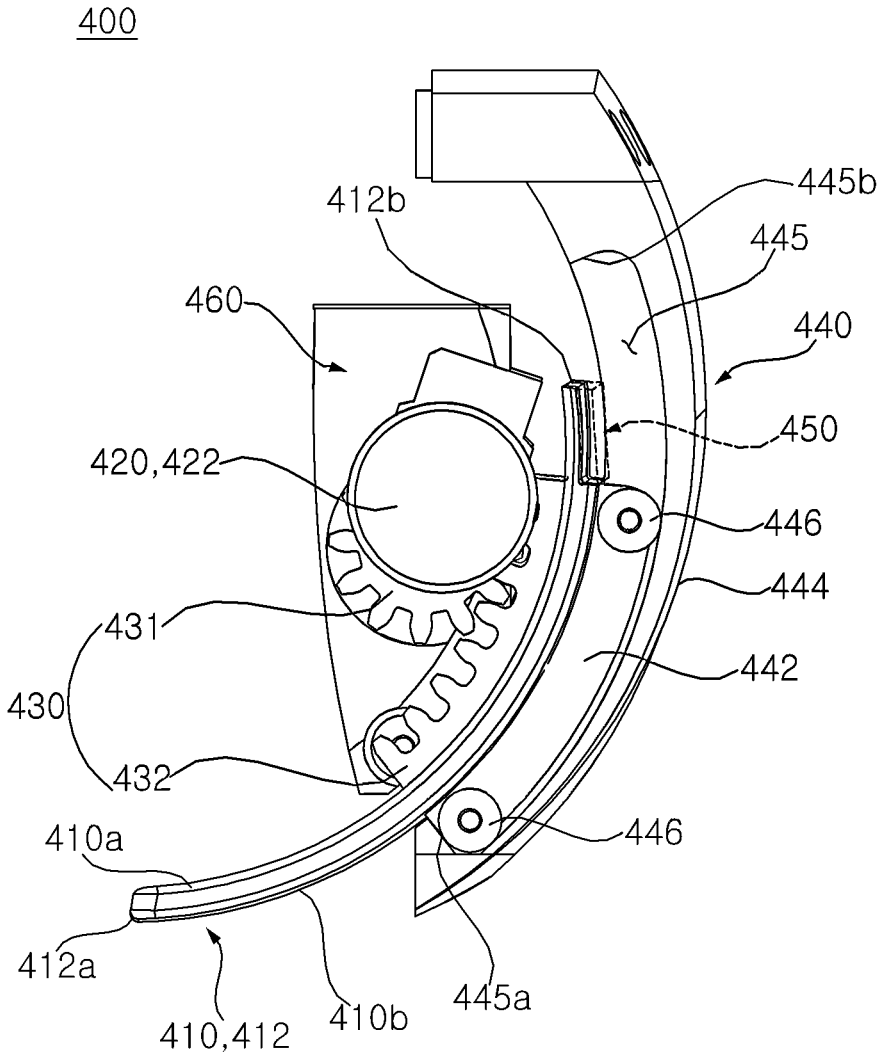
FIG. 14 is a plan view of FIG. 12.
Figure 15:
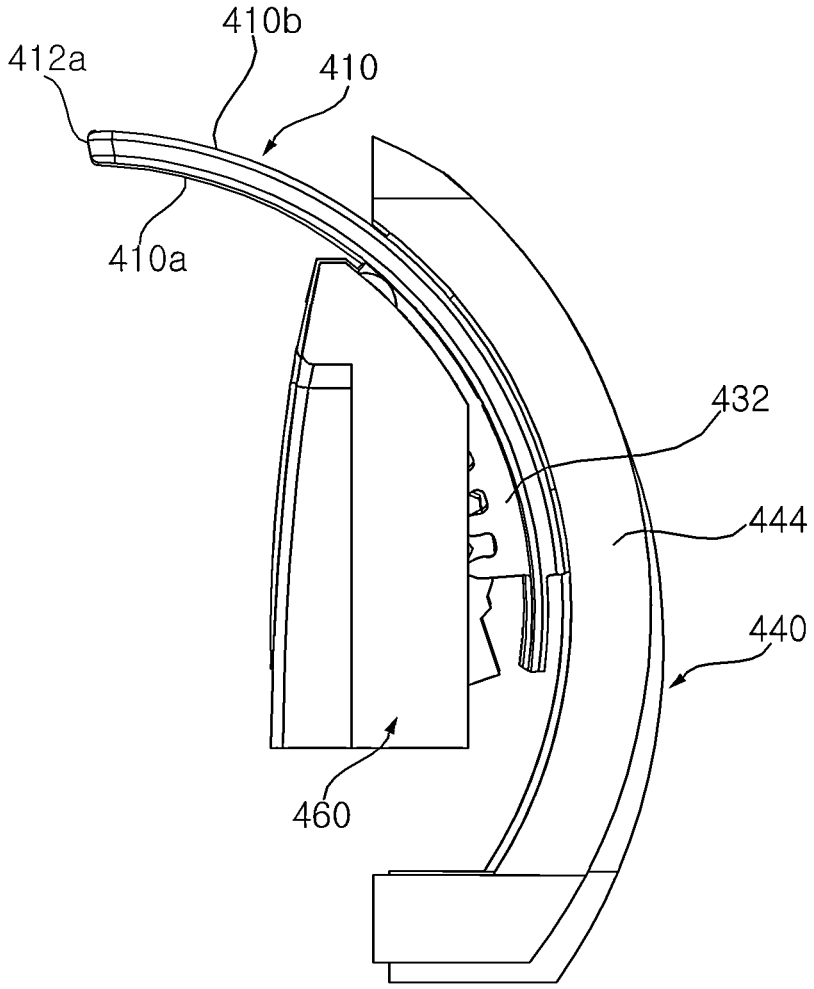
FIG. 15 is a bottom view of FIG. 12.

The gate 410 may be formed of a transparent material. Referring to FIG. 14, a light emitting member 450 such as a light emitting diode (LED) may be provided in the gate 410, and the entire gate 410 may be lit up through light generated from the light emitting member 450. The light emitting member 450 may be provided in the outer end 412*b* of the gate 410 to be in the discharge space 103 inside the tower 110 and 120. A plurality of light emitting members 450 may be provided along a length direction of the gate 410.

Referring back to FIG. 11, the guide motor 420 may include a first guide motor 421 providing rotational force to the first gate 411 and a second guide motor 422 providing rotational force to the second gate 412.

Figure 13:
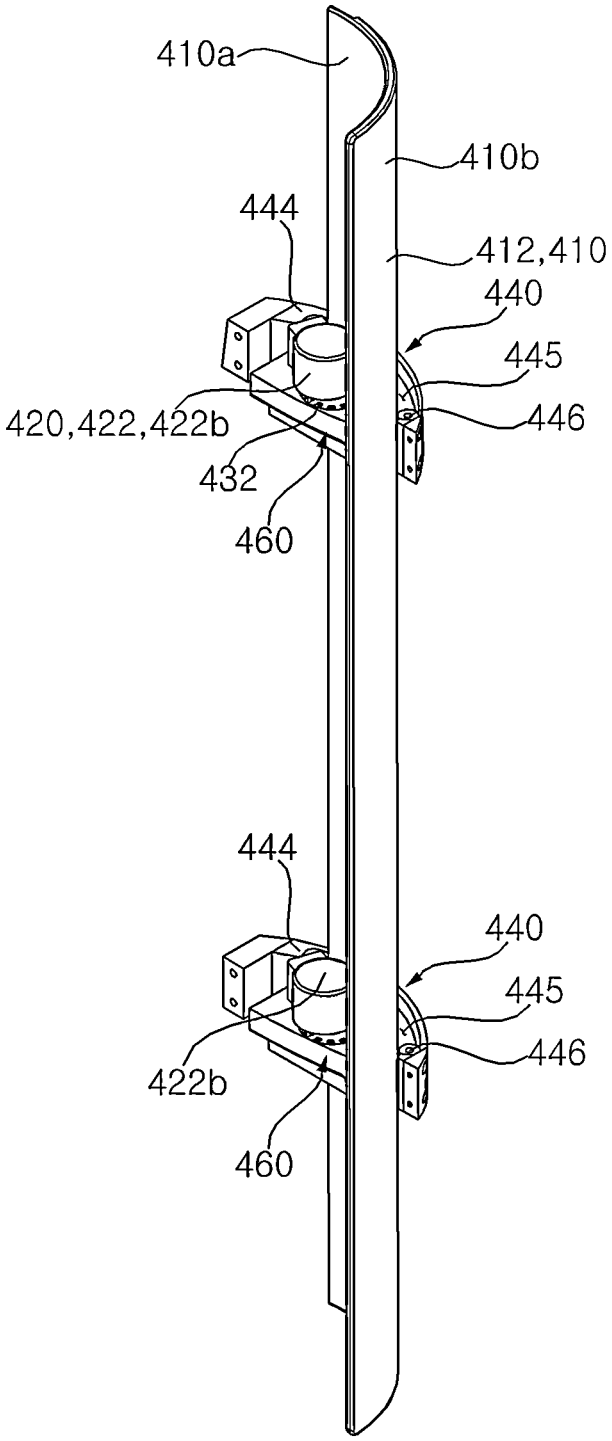
FIG. 13 is a perspective view of the air flow converter viewed from the opposite side of FIG. 12.

Referring to FIG. 13, the second guide motor 422 may include an upper second guide motor 422*a* provided at an upper portion of the second gate 412, and a lower second guide motor 422*b* provided at a lower portion of the second gate 412. Similarly, the first guide motor 421 may include an upper first guide motor 421 and a lower first guide motor 421. Rotation shafts of the first guide motor 421 and the second guide motor 422 may be provided in a vertical direction, and a rack-pinion structure may be used to transmit the driving force.

Referring to FIG. 14, the gear device 430 may include a driving gear 431 coupled to a motor shaft of the guide motor 420 and a rack 432 coupled to the gate 410. The driving gear 431 may be a pinion gear and may be rotated.

The rack 432 may be coupled to the inner surface of the gate 410. The rack 432 may be formed in a shape corresponding to the gate 410 (e.g., an arc shape). Teeth of the rack 432 may extend toward the inner wall of the tower 110 or 120. The rack 432 may be provided in the discharge space 103 and may be rotated together with the gate 410.

Hereinafter, the gate guider 440 will be described with reference to FIGS. 12 to 15. Referring to FIGS. 12-15, the gate guider 440 as shown may be provided in the second tower 120, but a same description may be applied to the gate guider 440 provided in the first tower 110. The gate guider 440 may be classified into a first gate guider provided in the first tower 110 and a second gate guider provided in the second tower 120. A configuration of the gate guider 440 described below may apply to both "a first" gate guider 440 provided in the first tower 110 and "a second" gate guide 440 provided in the second tower 120.

The gate guider 440 may guide a turning movement of and support the gate 410. Referring to FIG. 14, the gate guide 440 may be provided at an opposite side of the rack 432 based on the gate 410. The gate guider 440 may support a force applied from the rack 432. Alternatively, a groove corresponding to a turning radius of the gate 410 may be formed in the gate guide 440, and the gate 410 may be moved along the groove.

The gate guider 440 may be assembled or coupled to the outer wall 114 and 124 of the tower 110, 120. The gate guider 440 may be provided at an outside in a radial direction based on the gate 410, thereby reducing or minimizing contact with air flowing through the discharge space 103.

The gate guider 440 may include a movement guider 442, a fixed guider 444, and a friction reducing member 446. The movement guider 442 may be coupled to a structure that moves together with the gate 410. The movement guider 442 may be coupled to the rack 432 or the gate 410 and may be rotated together with the rack 432 or the gate 410.

The movement guider 442 may be provided at an outer surface 410*b* of the gate 410. The movement guider 442 may be formed in an arc shape and may have a same center of curvature as the gate 410. A length of the movement guider 442 may be formed to be shorter than a length of the gate 410.

The movement guider 442 may be provided between the gate 410 and the fixed guider 444. A radius of the movement guider 442 may be larger than a radius of the gate 410 and smaller than a radius of the fixed guider 444. The movement guider 442 may be in contact with the fixed guider 444 to limit movement.

The fixed guider 444 may be provided in the outside in a radial direction in comparison with the movement guider 442 and may support the movement guider 442. A guide groove 445 in which the movement guider 442 may be provided may be formed in the fixed guider 444. The guide groove 445 may be formed in correspondence with the rotation radius and curvature of the movement guider 442.

The guide groove 445 may be formed in an arc shape, and at least a part of the movement guider 442 may be inserted into the guide groove 445. The guide groove 445 may be formed to be concave in the downward direction. The movement guider 442 may move along the guide groove 445.

A front end 445*a* of the guide groove 445 may limit movement of the movement guider 442 in one direction (a direction protruding to the blowing space 105). A rear end 445*b* of the guide groove 445 may limit movement of the movement guider 442 in the other direction (a direction withdrawing inside the tower 110, 120).

The friction reducing member 446 may reduce friction between the movement guider 442 and the fixed guider 444. The friction reducing member 446 may be a roller to provide a rolling friction or movement between the movement guider 442 and the fixed guider 444. A shaft of the roller of the friction reducing member 446 may be formed in the vertical direction. The friction reducing member 446 may be coupled to the movement guider 442. The friction reducing member 446 may reduce friction and operating noise. At least a portion of the friction reducing member 446 may be provided to protrude to an outside in a radial direction in comparison with the movement guider 442.

The friction reducing member 446 may be formed of an elastic material and may be elastically supported by the fixed guider 444 in the radial direction. The friction reducing member 446 may contact the front end 445*a* or the rear end 445*b* of the guide groove 445.

The blower 1 may further include a motor mount 460 to support the guide motor 420 and fixing the guide motor 420 to the tower. Referring to FIG. 13, the motor mount 460 may be provided in a lower portion of the guide motor 420 and support the guide motor 420. The guide motor 420 may be assembled or coupled to the motor mount 460.

The motor mount 460 may be coupled to the inner wall 115, 125 of the tower 110, 120. The motor mount 460 may be manufactured integrally with the inner wall 115, 125.

Hereinafter, a disposition of the blower 1 and a flow of air in the horizontal and upward directions be described with reference to FIGS. 16 and 17. Referring to FIG. 16, when facilitating a horizontal airflow, the first gate 411 may be concealed or or inserted inside the first tower 110, and the second gate 412 may be concealed or inserted inside the second tower 120.

The discharged air from the first discharge port 117 and the discharged air from the second discharge port 127 may be joined in the blowing space 120 and pass through the front end 112, 122 to flow forward. The air in the rear side of the blowing space 105 may be guided forward. In addition, the ambient or nearby air around the first tower 110 may flow forward along the first outer wall 114, and the ambient or nearby air around the second tower 120 may flow forward along the second outer wall 124.

Since the first discharge port 117 and the second discharge port 127 may extend in the vertical direction and be vertically symmetrical, the air flowing in the upper side of the first discharge port 117 and the second discharge port 127 and the air flowing in the lower side may have a similar or uniform flow. The air discharged from the first discharge port 117 and the second discharge port 127 may be joined in the blowing space 105, thereby improving a straightness or streamlining of the discharged air and allowing the air to flow farther away from the blower 1.

Referring to FIG. 17, when facilitating an upward airflow, the first gate 411 and the second gate 412 may protrude in to the blowing space 105 and block the front of the blowing space 105. The inner end 411*a* of the first gate 411 and the inner end 412*a* of the second gate 412 may be in close contact with each other or may be slightly spaced apart.

As the front of the blowing space 105 may be blocked by the first gate 411 and the second gate 412, the air discharged from the discharge port 117, 127 may rise along a rear surface of the guide boards 411 and 412 and may be discharged out of a top of the blowing space 105.

Such a configuration guiding air upward may prevent discharged air from flowing directly to a user position in front of or at a side of the blower 1. Such a configuration may also facilitate a circulation of air in an indoor space. For example, when an air conditioner and a blower may be used simultaneously, the blower 1 may be operated to create an upward air flow to promote convection of indoor air, and indoor air may be cooled or heated more quickly.

Referring to FIG. 4, 11, 19, or 20, a concentrated airflow using the airflow converter 400 will be described in more detail. The air discharged forward in the when the gate 410 may be hidden or concealed inside of the first and/or second tower 410 and/or 420 may be referred to as a wide or forward airflow. The airflow concentrated or streamlined along the center line L-L' may be referred to as a concentrated airflow.

The concentrated airflow may concentrate the air discharged by the Coanda effect along the center line L-L' and to increase a straight travel distance or streamlined velocity so as to reach a farther area.

When the gate 410 passes through the inner wall 115, 125 and protrudes into the blowing space 105, the gate 410 may concentrate the air diffused in the left and right direction along the center line L-L'. Positions of the first board slit 119 and the second board slit 129 and a protrusion angle B of the gate 410 may be prescribed or predetermined to form an effective concentrated airflow.

Referring to FIG. 11, the protrusion angle B may be an angle between the outer surface 410*b* of the gate 410 and the center line L-L'. Since the gate 410 may be formed to have a curved surface, the protrusion angle B may be defined as an angle between a tangent line of the gate 410 at a point passing through the board slit 119, 129 and the center line L-L'.

A distance from the front end 112, 122 of the gate 410 to the board slit 119, 129 may be referred to as a distance or separation length D. The separation length D may be formed in a range of 5 millimeters (mm) to 10 mm. The separation length D may be a length between the front end 112, 122 and the inner surface 410*a* of the gate 410 in direct contact with the discharge air. The protrusion angle B may be formed from 0 degree to 60 degrees.

Figure 19:
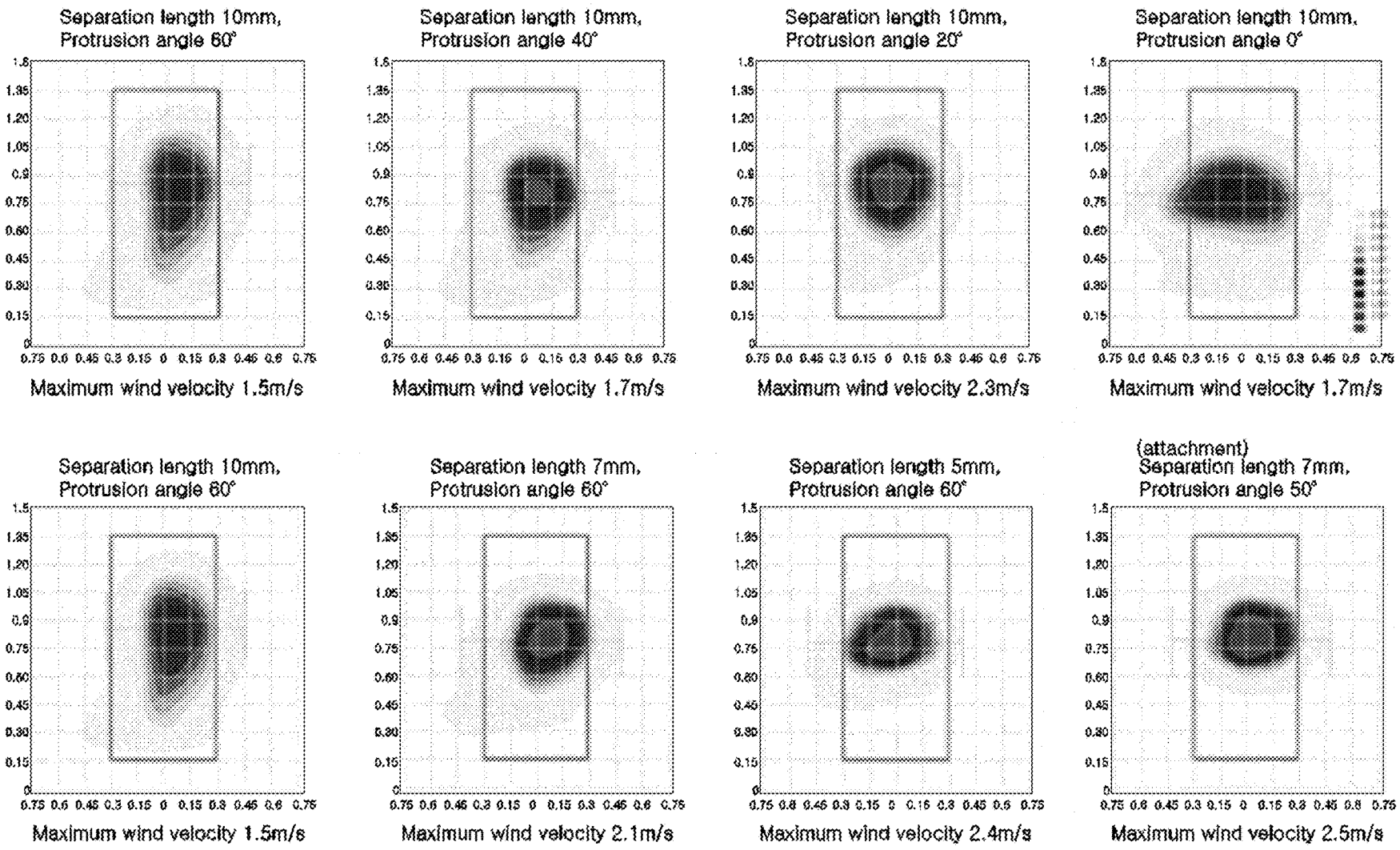
FIG. 19 is an exemplary view showing one-sided airflow of a blower according to the first embodiment.

Referring to FIG. 19, when the separation length D may be uniformly set to 10 mm and the protrusion angle B may be changed from 60 degrees to 0 degrees, a maximum air flow (or wind) velocity may increase and then decrease. When the protrusion angle B decreases from 60 degrees to 20 degrees the maximum air flow velocity may increase up to 2.3 meters per second (m/s). When the protrusion angle B decreases from 20 degrees to 0 degrees, the maximum air flow velocity decreases from 2.3 m/s to 1.7 m/s. When the protrusion angle B is uniformly set to 60 degrees and the separation length D is changed from 10 mm to 5 mm, the maximum air flow velocity may increase from 1.5 m/s to 2.4 m/s.

Figure 20:
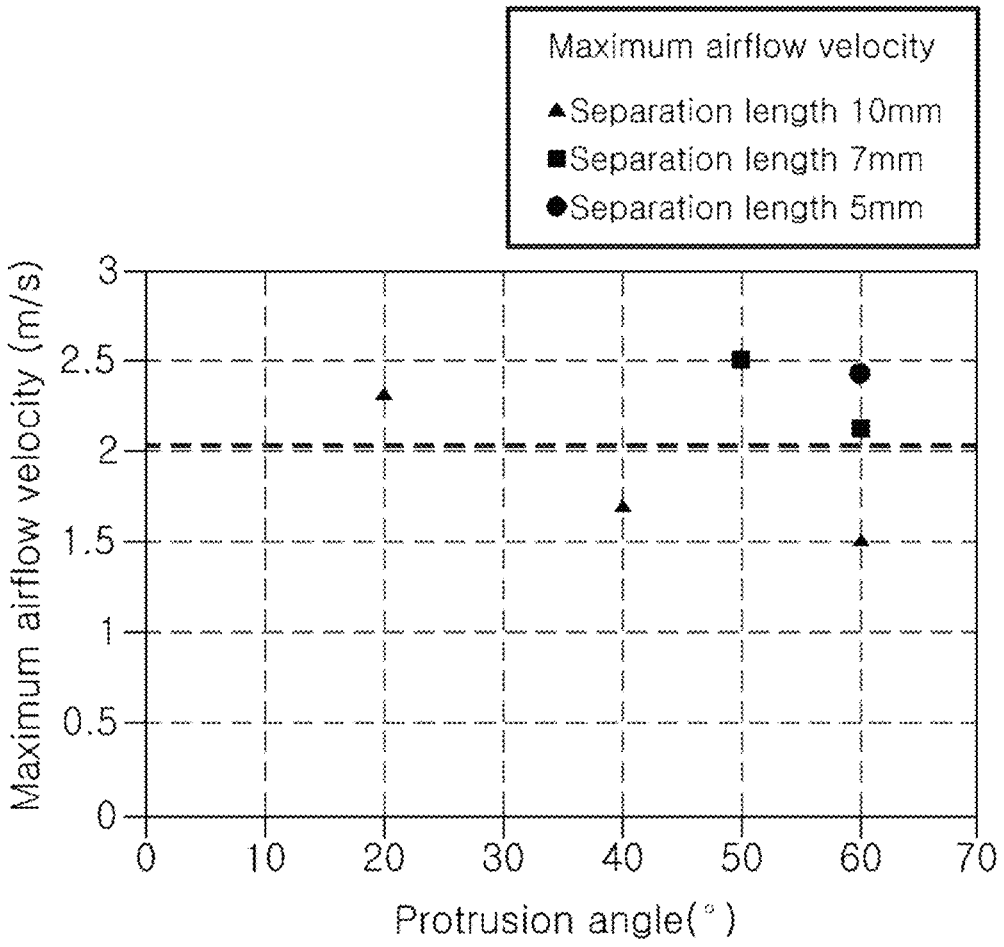
FIG. 20 is a graph showing one-sided airflow according to a protruding length of a gate.

Referring to FIGS. 19-20, as the separation length D increases, the maximum velocity of the airflow may decrease. As the protrusion angle B increases, the maximum velocity of the airflow may decrease.

When the separation distance D is 7 mm and the protrusion angle B is 50 degrees, a spread of airflow in the vertical or horizontal direction may be reduced or minimized, and the airflow may be concentrated along a center. When the separation distance D is 7 mm and the protrusion angle B is 50 degrees, the airflow may form a highest airflow or wind velocity.

When the separation distance D is 5 to 7 mm and the protrusion angle is 50 to 60 degrees, a maximum air flow velocity may be 2 m/s. The horizontal airflow where air flows forward of the blower 1 may include a wide airflow along the inner wall 115 of the first tower 110 and the inner wall 125 of the second tower 120, and one-sided airflow along the inner wall 115 of the first tower 110 and the inner wall 125 of the second tower 120 may be biased to the left or right by the first gate 411 or the second gate 412.

Figure 21:
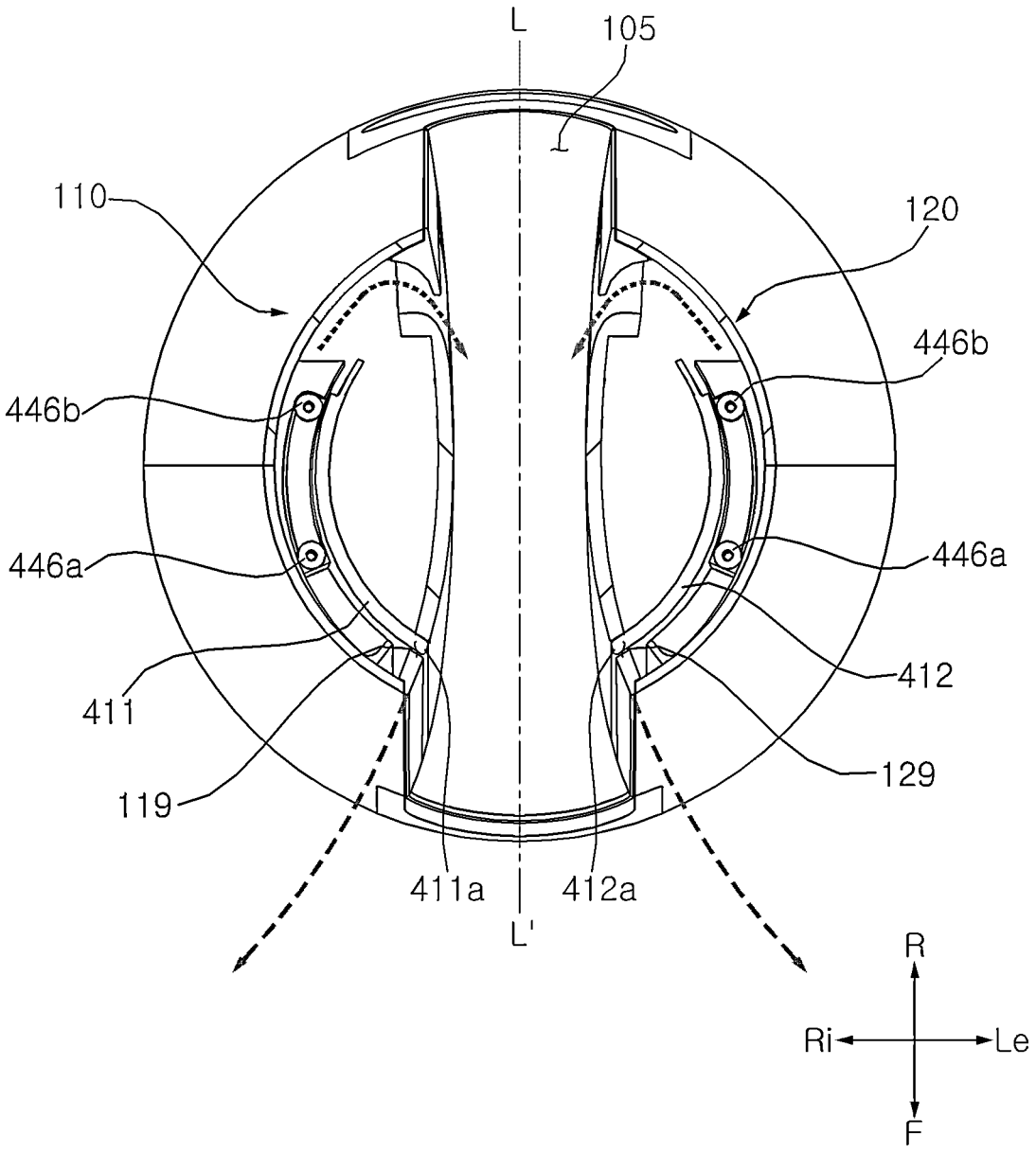
FIG. 21 is an exemplary view showing a wide airflow of a blower according to the first embodiment.

Hereinafter, with reference to FIGS. 14 and 21, a wide airflow of the blower 1 will be described. When a wide airflow setting or mode may be set, the first gate 411 may not protrude into the blowing space 105 and the second gate 412 may not to protrude into the blowing space 105. The first gate 411 may be concealed or inserted in the first tower 110 and the second gate 412 may be concealed or inserted in the second tower 120. The wide airflow setting may be directly selected by a user or may be selected as a default setting or value.

An inner end 411*a* of the first gate 411 may be provided within the first board slit 119 without protruding to an outside of the inner wall 115. The inner end 412*a* of the second gate 412 may not protrude to the outside of the inner wall 125 and may be provided in the second board slit 129. When the wide airflow setting is selected, the discharged air flowing through the blowing space 105 may be diffused in the horizontal direction along the discharge angle (A, see FIG. 4).

Hereinafter, one-sided or biased airflow of the blower 1 will be described with reference to FIGS. 22-24. When a first protruding length t1 of the first gate 411 that protrudes from the first inner wall 115 is different from a second protruding length t2 of the second gate 412 that protrudes from the second inner wall 125, one-sided airflow may be formed.

The discharged air may be steered or directed by setting or prescribing the first protruding length t1 of the first gate 411 and the second protruding length t2 of the second gate 412 to be different from each other. The first gate 411 or the second gate 412 may not protrude beyond the center line L-L'.

The point at which a maximum airflow velocity may be formed may be defined as an airflow center point, and an angle between the center line L-L' and the airflow center point may be defined as a steering angle. Referring to FIG. 22, view (a), when a rightward-sided airflow may be set, the inner end 411*a* of the first gate 411 may protrude from the first board slit 119 toward the blowing space 105, and the second gate 412 may be provided inside the second tower 120.

The first protruding length t1 of the first gate 411 may be adjusted so as to adjust an angle of the rightward-sided airflow. As the first protruding length t1 increases, a rightward angle may be increased.

Figure 22:
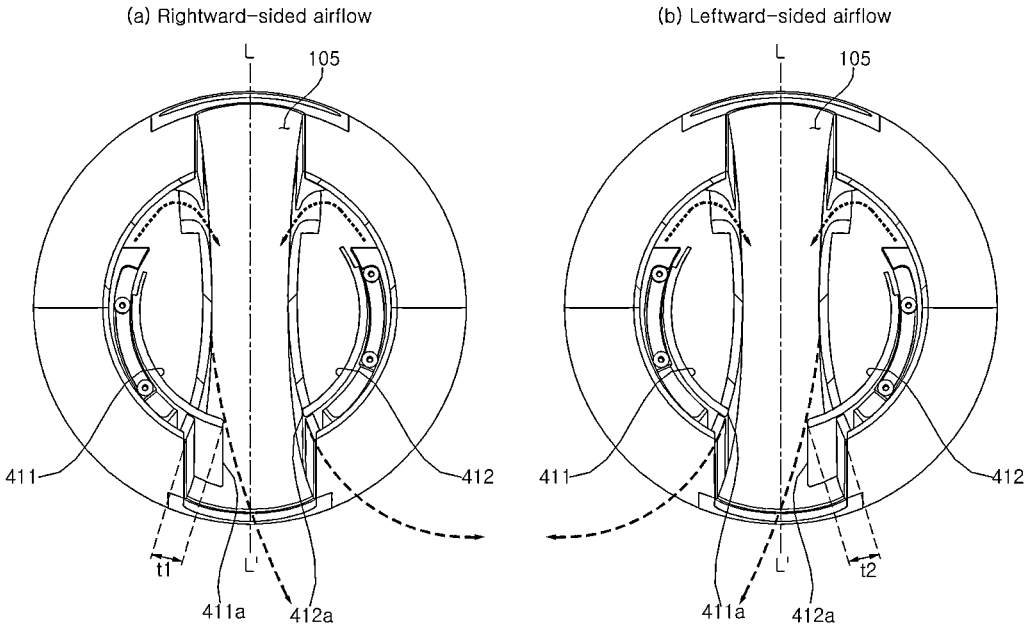
FIG. 22 is an exemplary view showing one-sided airflow of a blower according to the first embodiment.

Referring to FIG. 22, view (b), when a leftward-sided airflow may be set, the inner end 412*a* of the second gate 412 may protrude from the second board slit 129 toward the blowing space 105, and the first gate 411 may be provided inside the first tower 110.

An angle of the leftward-sided airflow may be adjusted by adjusting the second protruding length t2 of the second gate 412. As the second protruding length t2 increases, a leftward angle may increase.

The leftward-sided airflow and the rightward-sided airflow may be operated by receiving input through a remote controller, a control panel button, etc. Alternatively or in addition thereto, a camera configured to sense or recognize a user's position in a room may be provided, and the leftward-sided airflow and the rightward-sided airflow may be automatically selected according to the sensed position.

Figure 23:
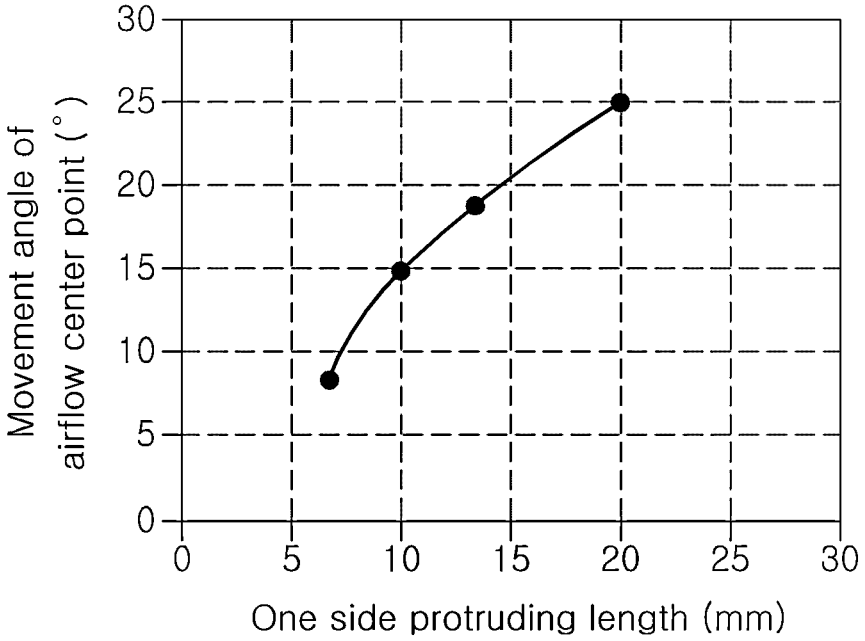
FIG. 23 is a graph showing one-sided airflow according to the protruding length.

FIG. 23 is a graph showing one-sided airflow according to the first protruding length t1 of the first gate at a height of 75 cm from floor. As the first protruding length t1 increases, a center of the airflow forming the maximum velocity may move to the right.

Figure 24:
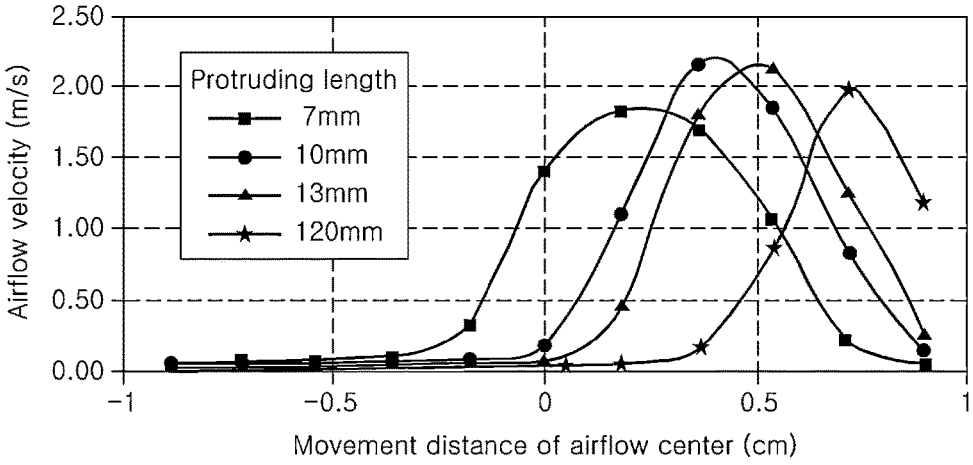
FIG. 24 is a graph showing the moving angle of an airflow center point according to the protruding length.

Referring to FIG. 24, as the first protruding length t1 increases from 0 to 10 mm, the maximum velocity of the airflow may be increased. As the first protruding length t1 exceeds 10 mm, the maximum velocity of the airflow may be decreased.

When the first protruding length t1 reaches a predetermined or critical point or length, the maximum airflow velocity may be increased by concentrating discharged air through the Coanda effect. When the first protruding length t1 exceeds the predetermined point, the maximum airflow velocity may be decreased as a resistance of the discharged air increases. As the first protruding length t1 increases, a direction of a center point of the airflow forming the maximum velocity may move to one side.

Figure 25:
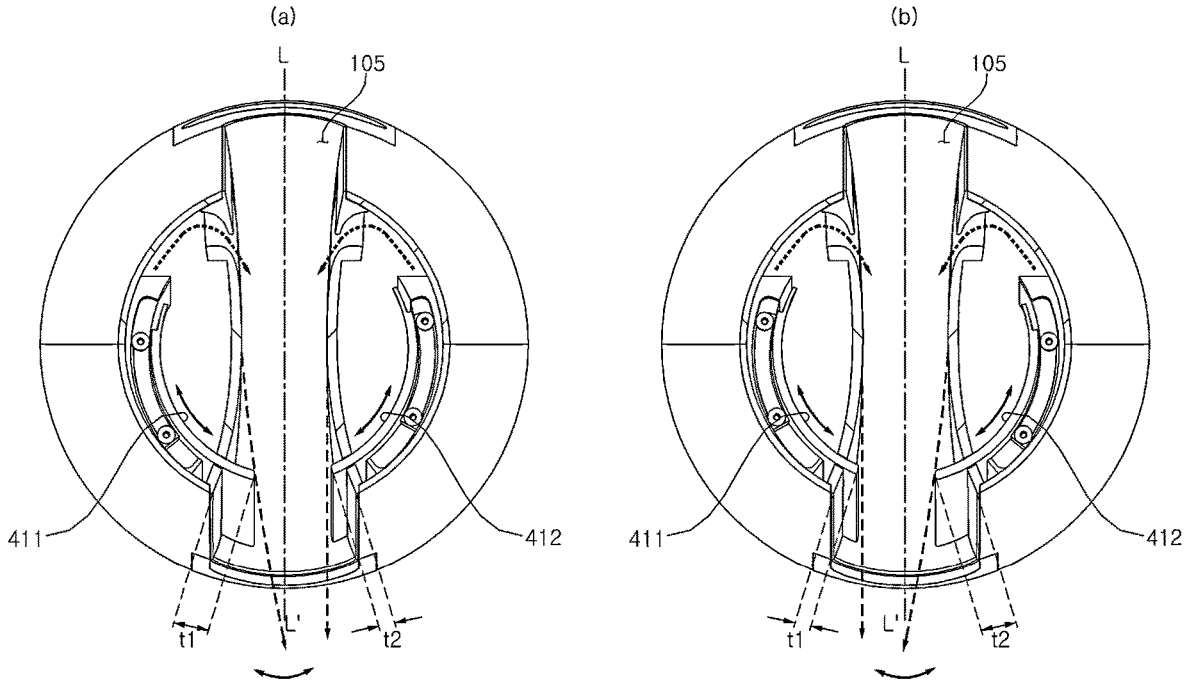
FIG. 25 is an exemplary view showing a concentrated rotation of a blower according to the first embodiment.

Referring to FIG. 25, concentrated rotation may refer to a mode in which discharged air may be reciprocated from left to right or from right to left. During concentrated rotation, a center point of the airflow may reciprocate in the left and right direction.

When the concentrated rotation is set, the first airflow converter 401 and the second airflow converter 402 may operate simultaneously. The first gate 411 and the second gate 412 may protrude to the blowing space 105. The first gate 411 and the second gate 412 may reciprocate without stopping.

The first protruding length t1 may be gradually increased and the second protruding length t2 may be gradually decreased. Alternatively, the second protruding length t2 may be gradually increased, and the first protruding length t1 may be gradually decreased. A distance between the inner ends 411*a* and 412*a* of the first gate 411 and the second gate 412 may be uniformly maintained.

The first gate 411 or the second gate 412 may not protrude beyond the center line L-L'. When the first protruding length t1 is gradually increased and the second protruding length t2 is gradually decreased, the discharged air may be formed to have a gradual rightward-sided airflow.

The rightward-sided airflow formed in the concentrated rotation may have a narrower airflow width than a non-rotating one-sided airflow because a distance between the inner ends 411*a* and 412*a* of the first gate 411 and the second gate 412 may be formed to be narrow. When the second protruding length t2 is gradually increased and the first protruding length t1 is gradually decreased, the discharged air may be have a gradual leftward-sided airflow.

The concentrated rotation may alternately provide a rightward-sided airflow and a leftward-sided airflow. In addition, the concentrated rotation may provide a narrow range of airflow with a higher air volume and a wider range of angle in comparison with a case where only a rightward-sided airflow or a leftward-sided airflow is provided.

Unlike concentrated rotation, wide rotation may be selected. Wide rotation may allow the discharged air to reciprocate from left to right or from right to left, and the center point of the airflow may reciprocate in the left and right direction. However, wide rotation may provide airflow having a wider airflow width than concentrated rotation.

During wide rotation, the first airflow converter 401 and the second airflow converter 402 may be sequentially operated. When the first gate 411 gradually reciprocates while forming the first protruding length t1, the second gate 412 may remain inside the second tower 120. Alternatively, when the second gate 412 gradually reciprocates while forming the second protruding length t2, the first gate 411 may remain inside the second tower 110. A wide rotation may repeat a process in which the first gate 411 may protrude to the center line L-L' and then be provided in the first board slit 119, and the second gate 412 may protrude to the center line L-L' and then may be provided in the second board slit 129.

Figure 26:
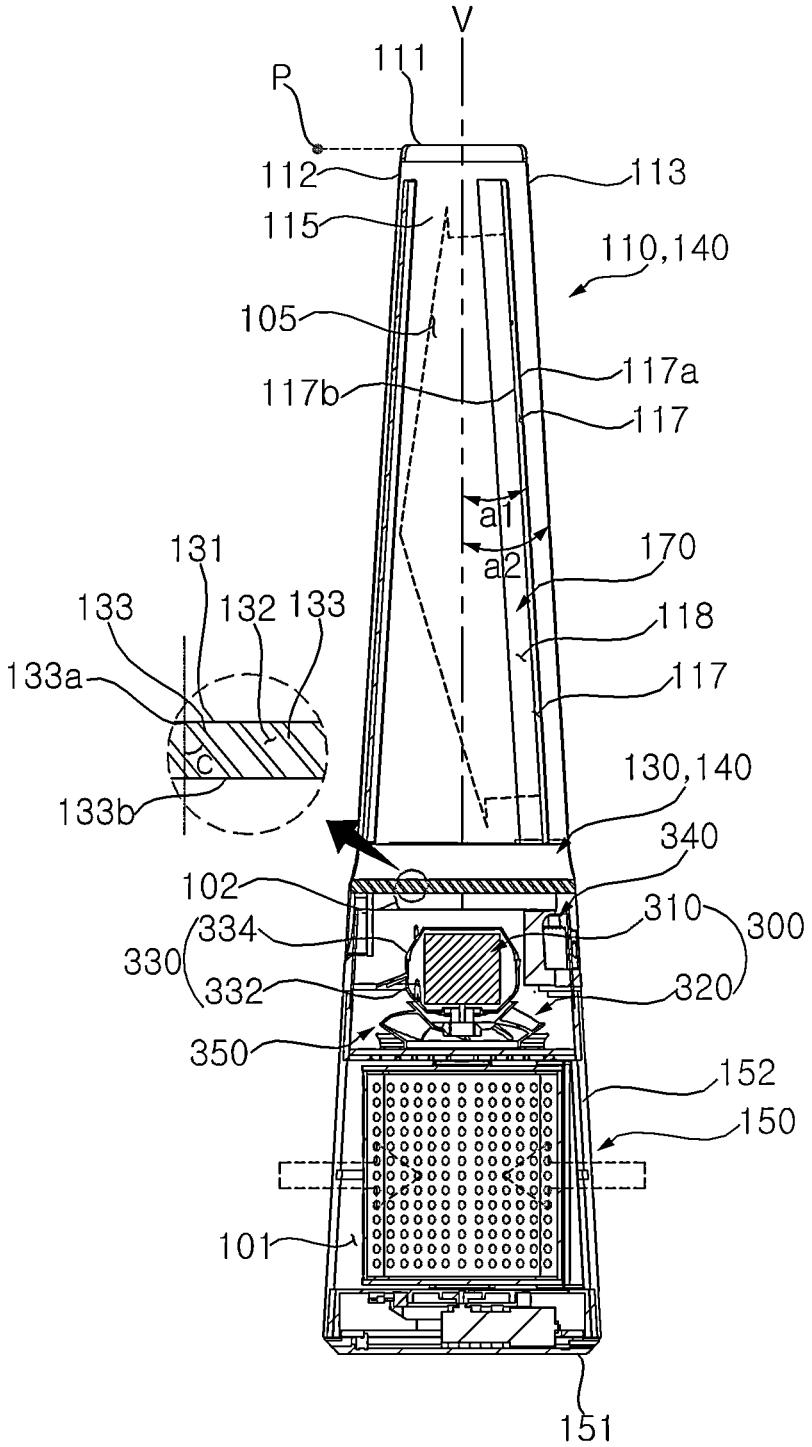
FIG. 26 is a right cross-sectional view of a blower according to a second embodiment.

Hereinafter, a blower including a third air guide 133 will be described with reference to FIGS. 26 to 28. Referring to FIG. 26, a third discharge port 132 penetrating the upper surface 131 of the tower base 130 in the vertical direction may be formed. A third air guide 133 to guide rising air may be provided in the third discharge port 133.

The third air guide 133 may be provided to be inclined with respect to the vertical direction. The upper end 133*a* of the third air guide 133 may be provided ahead or in front of the lower end 133*b*. The third air guide 133 may include a plurality of vanes which are provided spaced apart from each other in the front-rear direction. The third air guide 133 may be provided between the first tower 110 and the second tower 120 and below the blowing space 105 to discharge air toward the blowing space 105. An inclination of the third air guide 133 with respect to the vertical direction may be defined as an air guide angle C. FIG. 27 shows a value obtained by measuring the airflow velocity with respect to the air guide angle C measured at a point P of 50 centimeters (cm) in front of the upper end 133*a*. The airflow velocity for the air guide angle C may be measured according to the number of vanes.

Figure 27:
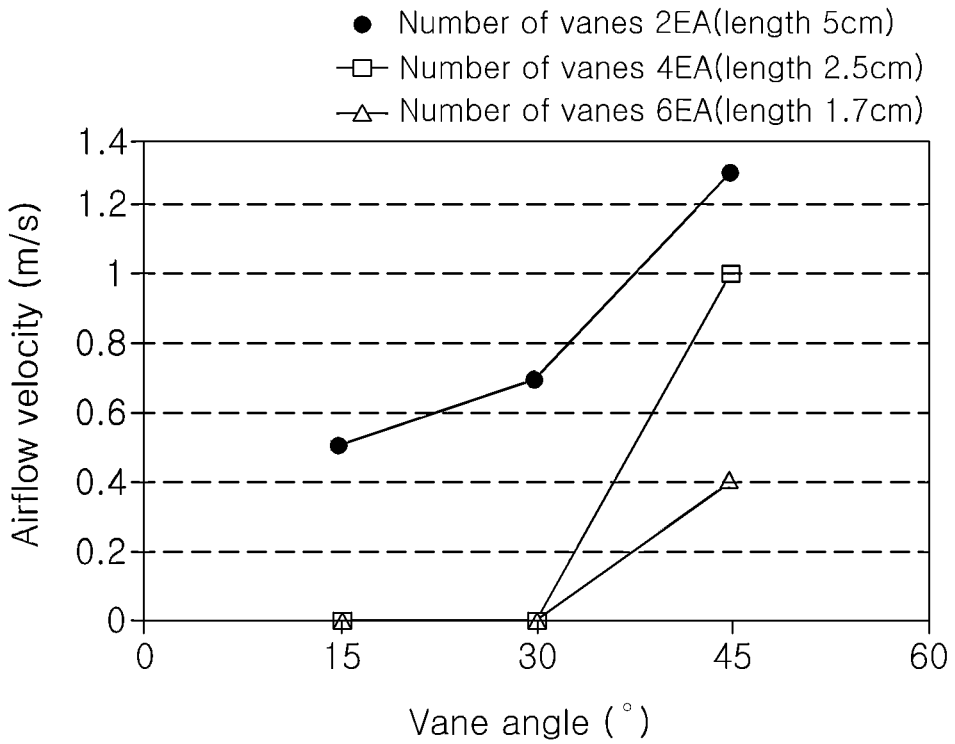
FIG. 27 is a graph showing the airflow velocity at 50 cm ahead with respect to the angle of the air guide.

Referring to FIG. 27, when the number of vanes is four or more, if the air guide angle C are less than 30 degrees, the airflow velocity at the point P may converge to zero. When the number of vanes is two, even if the air guide angle C is reduced, the airflow from the point P toward the front may be measured.

Figure 28:
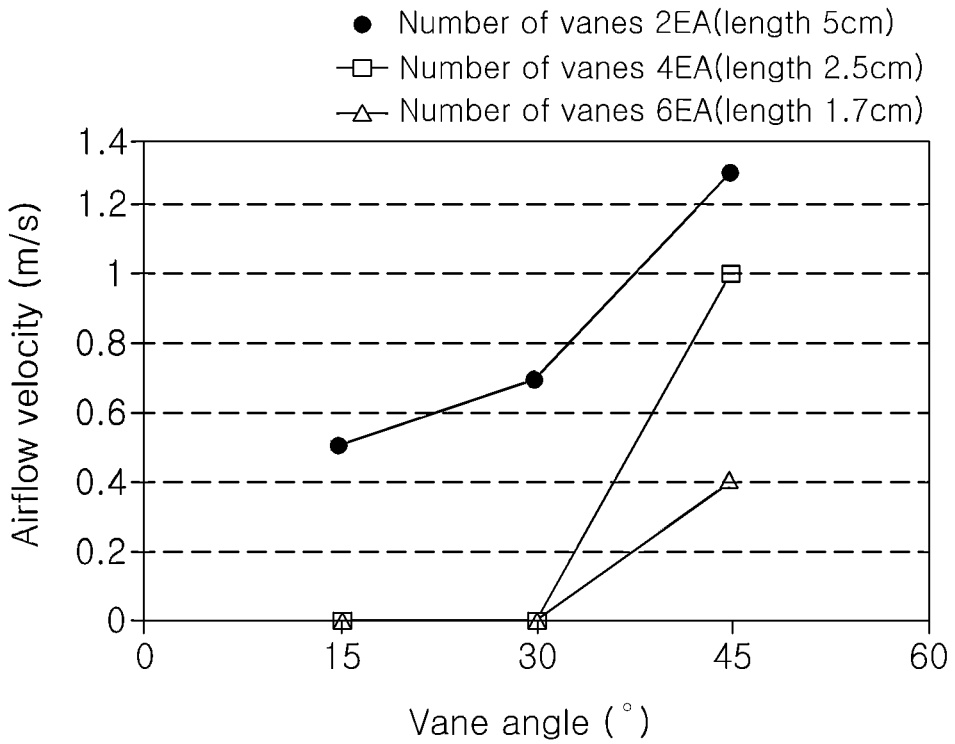
FIG. 28 is a graph showing the airflow velocity at the upper end with respect to the angle of the air guide.

FIG. 28 shows a value obtained by measuring the airflow velocity at the upper end 111. Referring to FIG. 28, when the number of vanes is two, four, or six, the airflow velocity may be measured at the upper end 111. When the number of vanes is four or six, the airflow velocity may decrease as the air guide angle C increases. Summarizing the results of FIGS. 27 and 28, the third air guide 133 may minimize air flowing forward only when at least four vanes are provided, and may secure the airflow velocity of the air that flows upward.

This application is related to co-pending U.S. application Ser. No. 17/190,692 filed Mar. 3, 2021, U.S. application Ser. No. 17/191,873 filed Mar. 4, 2021, U.S. application Ser. No. 17/197,918 filed Mar. 10, 2021, U.S. application Ser. No. 17/318,222 filed May 12, 2021, U.S. application Ser. No. 17/332,681 filed May 27, 2021, and U.S. application Ser. No. 17/318,242 filed May 12, 2021, whose entire disclosures are incorporated by reference herein.

Embodiments disclosed herein may change a wind direction of air discharged from a blower without rotating the blower itself. Air discharged from the blower may form an upward airflow in addition to a horizontal airflow, thereby circulating air in an indoor space.

Embodiments disclosed herein may deflect a wind direction of the air discharged from the blower. The wind direction of the air discharged from the blower may be continuously changed without rotating the blower itself.

Embodiments disclosed herein may provide a blower capable of selectively providing a horizontal airflow or an upward airflow. Embodiments disclosed herein may provide a blower that provides a forward deflected airflow. Embodiments disclosed herein may provide a blower in which an area of discharged air may be changed without rotation of the entire body.

Embodiments disclosed herein may provide a blower including a first tower which has a first discharge port formed in a first wall, a second tower in which a second wall facing the first wall may be spaced apart from the first wall, a second discharge port being formed in the second wall, a fan provided below the first tower and the second tower to form an air flow toward each of the first tower and the second tower, a first gate which may be provided inside the first tower or protrudes from the first wall, a second gate which may be provided inside the second tower or protrudes from the second wall, a first guide motor to change a disposition or position of the first gate, and a second guide motor to change a disposition or position of the second gate. A blowing space through which air discharged from the first discharge port and the second discharge port flows in one direction may be formed between the first wall and the second wall, and each of the first gate and the second gate may be provided downstream of the blowing space so as to change a wind direction of air flowing from the blowing space, adjusting the wind direction of the air discharged from the blowing space The first guide motor may position the first gate inside the first tower or adjust a height, length, or distance protruding from the first wall. The second guide motor may position the second gate inside the second tower or adjust a height, length, or distance protruding from the second wall, thereby adjusting the height or length of the first gate and the second gate protruding toward the blowing space.

The first guide motor and the second guide motor may be individually operated so that the distances of the first gate and the second gate protruding to the blowing space may be set or prescribed differently. Each of the first wall and the second wall may form a convex curved surface in a facing direction, so that air flowing through the blowing space may flow along the first wall and the second wall.

A width between the first wall and the second wall may form a shortest distance between a point in which the first discharge port and the second discharge port are formed and a point in which the first gate and the second gate are provided, so that air flowing through the blowing space may flow along the first wall and the second wall. Each of a downstream end of the first wall and a downstream end of the second wall may form an inclination angle in a direction away from a virtual center line passing through centers of the first tower and the second tower, so that the air discharged from the blowing space may flow into a wide area.

The first discharge port may be opened to allow air discharged from the first discharge port to flow along the first wall, and the second discharge port may be opened to allow air discharged from the second discharge port to flow along the second wall, so that air flowing through the blowing space may flow along the first wall and the second wall. The blower may include a first gate guider provided inside the first tower to guide a movement of the first gate and a second gate guide provided inside the second tower to guide a movement of the second gate, so that the first gate and the second gate may move stably.

Each of the first gate guide and the second gate guide may include a fixed guider fixedly provided inside the first tower or the second tower and a movement guider connected to the first gate or the second gate and provided movably in the fixed guider. A rack, which may be connected to the first guide motor or the second guide motor and moves the first gate or the second gate, may be provided on one surface of the first gate or the second gate, and the movement guider may be provided on the other surface of the first gate or the second gate, so that the disposition of the first gate and the second gate may be changed.

In a horizontal airflow mode in which air may be discharged to a front of the blowing space, each of the first gate and the second gate may be provided inside the first tower and the second tower, so that air flowing through the blowing space may be discharged forward. In an upward airflow mode in which air may be discharged to an upper side of the blowing space, an end of the first gate may be in contact with an end of the second gate, so that air flowing through the blowing space may flow upward.

In a one-sided airflow mode in which air discharged from the blowing space may form an one-sided airflow, a length of the first gate protruding from the first wall may be formed to be different from a length of the second gate protruding from the second wall so that air flowing through the blowing space may flow to be deflected to one side of the front. In the one-sided airflow mode, one of the first gate and the second gate may be provided to protrude to the blowing space, and the other may be provided not to protrude to the blowing space so that air flowing through the blowing space may flow to be deflected to one side of the front. In the one-sided airflow mode, the first guide motor and the second guide motor may be operated in such a manner that the first gate protrudes from the first wall or the second gate protrudes from the second wall, so that air flowing through the blowing space may flow to be deflected to one side of the front.

In a moving mode in which a wind direction of air discharged from the blowing space may be continuously changed, the first gate and the second gate may be alternately protruded or moved so that the wind direction of the air flowing forward may be changed continuously. In the moving mode, when the first gate protrudes from the first wall, the second gate may be provided inside the second tower, and when the second gate protrudes from the second wall, the first gate may be provided inside the first tower, so that the wind direction of the air may be changed to a wide area ahead.

In the moving mode, when a length of the first gate protruding from the first wall may be changed, the second gate may be provided inside the second tower, and when a length of the second gate protruding from the second wall may be changed, the first gate may be provided inside the first tower, so that the wind direction of the air can be changed to a wide area ahead. In the moving mode, a distance between the first gate and the second gate may be uniformly maintained so that the wind direction of the air can be changed to the concentrated area.

In the moving mode, when a length of the first gate protruding from the first wall increases, a length of the second gate protruding from the second wall may decrease. When the length of the second gate protruding from the second wall increases, the length of the first gate protruding from the first wall may decrease. The wind direction of the air may be changed to the concentrated area.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A blower, comprising:

a first tower having a first wall;

a second tower having a second wall facing the first wall and spaced apart from the first wall to form a blowing space therebetween, a first discharge port formed in the first wall and configured such that air flowing through the first discharge port is discharged to the blowing space;

a second discharge port formed in the second wall and configured such that air flowing through the second discharge port is discharged to the blowing space and joined with the air discharged from the first discharge port to create an air flow in a first direction;

a fan provided below the first and second towers and configured to guide air toward the first and second towers;

a first gate provided inside the first tower at a position spaced apart from the first discharge port;

a second gate provided inside the second tower at a position spaced apart from the second discharge port;

a first motor configured to change a position of the first gate to guide at least some of the air flowing in the first direction to flow in a second direction; and a second motor configured to change a position of the second gate to guide at least some of the air flowing in the first direction to flow in the second direction.

2. The blower of claim 1, wherein the first motor is configured to move the first gate to be completely inside the first tower or to protrude from the first wall into the blowing space, and the second motor is configured to move the second gate to be completely inside the second tower or to protrude from the second wall into the blowing space.

3. The blower of claim 1, wherein the first motor and the second motor are individually operated.

4. The blower of claim 1, wherein each of the first wall and the second wall have a convex curvature such that the first wall is curved toward the second wall and the second wall is curved toward the first wall.

5. The blower of claim 4, further comprising:

a first slit provided on the first wall through which the first gate moves; and a second slit provided on the second wall through which the second gate moves, wherein a first distance between centers of the first wall and the second wall is shorter than a second distance between the first discharge port and the second discharge port, and the first distance is also shorter than a third distance between the first slit and the second slit.

6. The blower of claim 1, wherein each of an end of the first wall provided downstream of the air flowing in the first direction and an end of the second wall downstream of the air flowing in the first direction forms an inclination angle in a direction away from a virtual center line passing through centers of the first tower and the second tower.

7. The blower of claim 1, wherein the first discharge port has a shape configured to allow air discharged from the first discharge port to flow along the first wall, and the second discharge port has a shape configured to allow air discharged from the second discharge port to flow along the second wall.

8. The blower of claim 1, further comprising:

a first guide provided inside the first tower to guide a movement of the first gate; and a second guide provided inside the second tower to guide a movement of the second gate.

9. The blower of claim 8, wherein the first guide includes:

a fixed guide fixed inside the first tower;

a movement guide which is provided on a first surface of the first gate and configured to move relative to the fixed guide; and a rack connected to the first motor and provided on a second surface of the first gate to move the first gate, the first and second surfaces being opposite to each other.

10. The blower of claim 1, wherein, in a first mode configured to facilitate air flow in the first direction, the first and second motors are operated such that each of the first gate and the second gate are provided inside the first tower and the second tower.

11. The blower of claim 1, wherein in a second mode configured to facilitate air flow in the second direction, the first and second motors are operated such that an end of the first gate is in contact with an end of the second gate.

12. The blower of claim 1, wherein in a third mode configured to facilitate air flow that is biased to a side with respect to a center of the blowing space, the first and second motors are operated such that a protruding length of the first gate in the blowing space is different from a protruding length of the second gate.

13. The blower of claim 12, wherein in the third mode, the first motor is operated such that the first gate protrudes into the blowing space, and the second motor is operated such that the second gate is provided inside of the second tower so as not to protrude into the blowing space.

14. The blower of claim 1, wherein in a fourth mode configured to continuously change an air flow direction, the first and second motors are operated such that the first gate and the second gate are alternately protruded into the blowing space.

15. The blower of claim 14, wherein in the fourth mode, wherein the first and second motors are operated such that, when the first gate is protruded from the first wall into the blowing space, the second gate is provided inside the second tower so as not to protrude into the blowing space, and when the second gate is protruded from the second wall into the blowing space, the first gate is provided inside the first tower so as not to protrude into the blowing space.

16. The blower of claim 14, wherein in the fourth mode, the first and second motors are operated such that, when a protruding length of the first gate into the blowing space is changed, the second gate is provided inside the second tower so as not to protrude into the blowing space, and when a protruding length of the second gate into the blowing space is changed, the first gate is provided inside the first tower so as not to protrude into the blowing space.

17. The blower of claim 14, wherein in the fourth mode, the first and second motors are operated such that a distance between the first gate and the second gate is maintained during a movement of the first and second gates.

18. The blower of claim 14, wherein in the fourth mode, the first and second motors are operated such that, when a protruding length of the first gate into the blowing space increases, a protruding length of the second gate into the blowing space decreases, and when the protruding length of the second gate increases, the protruding length of the first gate decreases.

19. A blower, comprising:

a lower case having an inlet;

an upper case provided above the lower case; and a fan configured to suction air through the inlet and discharge air into an inner space of the upper case, the upper case including:

a first tower having a first outlet and a first slit, a second tower spaced apart from the first tower and having a second outlet and a second slit, wherein outer surfaces of the first and second towers are curved, a first gate which is curved, a first motor configured to move the first gate through the first slit, a second gate which is curved, and a second motor configured to move the second gate through the second slit, wherein positions of the first and second slits are configured such that the first and second slits are downstream of air discharged out of the first and second outlets.

20. The blower of claim 19, wherein a bottom of the upper case has a discharge port and a plurality of inclined vanes.

* * * * *